US009702533B1

(12) United States Patent
Harpenau et al.

(10) Patent No.: US 9,702,533 B1
(45) Date of Patent: Jul. 11, 2017

(54) METHOD AND SYSTEM FOR LUMINAIRE MOUNTING

(71) Applicants: Kevin Harpenau, Peachtree City, GA (US); Grzegorz Wronski, Peachtree City, GA (US); Lin Zhihong, Shanghai (CN)

(72) Inventors: Kevin Harpenau, Peachtree City, GA (US); Grzegorz Wronski, Peachtree City, GA (US); Lin Zhihong, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 525 days.

(21) Appl. No.: 14/191,211

(22) Filed: Feb. 26, 2014

Related U.S. Application Data

(60) Provisional application No. 61/769,652, filed on Feb. 26, 2013.

(51) Int. Cl.
*F21V 15/00* (2015.01)
*F21V 21/03* (2006.01)

(52) U.S. Cl.
CPC ..... *F21V 21/03* (2013.01)

(58) Field of Classification Search
CPC ..... F21V 21/03; F21V 21/043; F21V 21/049
USPC ..... 362/365
See application file for complete search history.

(56) References Cited

U.S. PATENT DOCUMENTS

| | | | |
|---|---|---|---|
| D1,293 | S | 7/1860 | Pardii |
| D15,850 | S | 2/1885 | Brownell |
| D53,619 | S | 7/1919 | Stutz |
| D60,711 | S | 3/1922 | Walsh |
| 1,699,339 | A | 1/1929 | Alaj |
| D81,764 | S | 8/1930 | Stoyanoff |
| 2,185,866 | A | 1/1940 | Paige |
| D140,205 | S | 1/1945 | Lyon |
| 2,736,610 | A | 2/1956 | Waite |
| 2,874,561 | A | 2/1959 | Alger |
| 2,954,629 | A | 10/1960 | Matin |
| 3,223,834 | A | 12/1965 | Lorio |
| 3,543,224 | A | 11/1970 | Fisher |
| D253,829 | S | 1/1980 | Mielke et al. |
| D258,017 | S | 1/1981 | Steinkamp et al. |
| D334,667 | S | 4/1993 | Lonczak et al. |
| D338,288 | S | 8/1993 | Key |

(Continued)

OTHER PUBLICATIONS

Robert Monk Electric, "Commercial Electric's T91 retrofit recess/new construction LED wows," http://www.phillylicensedelectrician.com/commercial-electrics-t91-retrofft-recessnew-construction-led-wows; Sep. 13, 2012.

(Continued)

*Primary Examiner* — Bryon T Gyllstrom
(74) *Attorney, Agent, or Firm* — King & Spalding LLP

(57) ABSTRACT

A bracket can connect a luminaire to a junction box or other housing or structure, for example at a ceiling. The bracket can be mounted to the junction box using one or more fasteners. The bracket can comprise two tabs, and the luminaire can comprise two corresponding slots. Alternatively, the bracket can comprise two slots, and the luminaire two corresponding tabs. The luminaire can be attached to the bracket by positioning the luminaire so that the two tabs are inserted into the two slots and rotating the luminaire so the slots and tabs engage and lock.

19 Claims, 24 Drawing Sheets

(56) References Cited

U.S. PATENT DOCUMENTS

| | | | | |
|---|---|---|---|---|
| 5,567,041 | A * | 10/1996 | Slocum | F21S 8/02 362/148 |
| D379,125 | S | 5/1997 | Simjian | |
| D437,492 | S | 2/2001 | Wai | |
| D445,526 | S | 7/2001 | Wang | |
| D454,256 | S | 3/2002 | Johnson | |
| 6,361,193 | B1 * | 3/2002 | Gabrius | F21S 8/02 362/147 |
| D469,211 | S | 1/2003 | Homann | |
| D482,484 | S | 11/2003 | Benghozi | |
| D514,733 | S | 2/2006 | Benensohn | |
| D516,255 | S | 2/2006 | Maguire | |
| 7,070,306 | B2 | 7/2006 | Cousin | |
| D554,316 | S | 10/2007 | Brothers | |
| 7,322,722 | B2 * | 1/2008 | Hartmann, Jr. | F21S 8/02 362/147 |
| 7,399,104 | B2 * | 7/2008 | Rappaport | F21S 8/02 362/147 |
| D601,744 | S | 10/2009 | Sakuma | |
| D604,454 | S | 11/2009 | Majidi | |
| 7,736,031 | B1 | 6/2010 | Rashidi | |
| 7,789,522 | B2 * | 9/2010 | Steadman | F21S 8/02 362/147 |
| D644,351 | S | 8/2011 | Hasse | |
| D647,227 | S | 10/2011 | Kaule et al. | |
| D655,850 | S | 3/2012 | Sabernig | |
| D656,264 | S | 3/2012 | Janssen | |
| D667,985 | S | 9/2012 | Gielen | |
| D681,867 | S | 5/2013 | Wegget et al. | |
| D688,394 | S | 8/2013 | Tsai | |
| D689,212 | S | 9/2013 | Chyan et al. | |
| D691,321 | S | 10/2013 | Chen et al. | |
| D691,745 | S | 10/2013 | Wang et al. | |
| D695,927 | S | 12/2013 | Anderson et al. | |
| 2003/0210551 | A1 * | 11/2003 | Sevack | F21S 8/02 362/365 |
| 2007/0025110 | A1 * | 2/2007 | Langlois | F21V 19/02 362/427 |
| 2008/0225531 | A1 * | 9/2008 | Shiller | F21S 8/02 362/365 |
| 2009/0147517 | A1 * | 6/2009 | Li | F21V 21/046 362/249.02 |
| 2010/0110699 | A1 | 5/2010 | Chou | |
| 2011/0075414 | A1 * | 3/2011 | Van De Ven | F21V 15/01 362/235 |
| 2011/0080727 | A1 | 4/2011 | Maxik et al. | |
| 2013/0128578 | A1 * | 5/2013 | Yu | F21S 8/04 362/244 |

OTHER PUBLICATIONS

Amazon.com; T67/Commercial Electric 6 In. Recessed Soft White Disk Light; Specification Sheet; May 2, 2013.

Lighting Science; Glimpse LED Retrofit & Surface Mount Fixture Installation Manual; Jan. 2013.

Sylvania; Ultra Light Disk LED: Recessed and Surface Mount Downlight Kit; Nov. 2013.

* cited by examiner

METHOD AND SYSTEM FOR LUMINAIRE MOUNTING

CROSS REFERENCE TO RELATED APPLICATIONS

This application claims priority to U.S. Provisional Patent Application No. 61/769,652 filed Feb. 26, 2013 in the name of Kevin Harpenau, Grzegorz Wronski, and Lin Zhihong and entitled "Systems, Methods, and Devices for Connecting a Luminaire to a Junction Box," the entire contents of which are hereby incorporated herein by reference.

FIELD OF THE TECHNOLOGY

Embodiments of the disclosure relate generally to lighting solutions, and more particularly to technology for mounting a luminaire, such as to a junction box or other structure.

BACKGROUND

Luminaires are often positioned adjacent or above an area to be illuminated, such as a room, a space frequented by people, or other location. Utilizing conventional mounting approaches, such luminaires are often cumbersome or inefficient in terms of installation and/or service. Additionally, conventional luminaire mounting systems often expose the illuminated area to fastening elements that are either unsightly, distracting, or expensive to produce in a form that is sightly.

Improved technology for mounting luminaires in needed. Need exists for improved efficiency of installation and service. Need exists for improved manufacturing economics. Need exists for improved simplicity and reduction in part count. Need exists for a capability to improve visual appeal of luminaires and their associated mounting facilities. Further need exists for improvements in terms of reliability, economy, usability, simplicity, compactness, and visual appeal, for example.

A capability addressing one or more such needs, or some other related deficiency in the art, would support economical illumination systems.

SUMMARY

A luminaire can be mounted to a junction box or other structure that may be disposed adjacent a ceiling, wall, or other surface. A bracket can be attached to the junction box or other structure, using one or more fasteners. The bracket can comprise two protrusions, and the luminaire can comprise two corresponding apertures. Alternatively, the bracket can comprise two apertures, and the luminaire two corresponding protrusions. The luminaire can be attached to the bracket by positioning the luminaire so that the two protrusions are aligned with the two apertures and then moving the luminaire so the apertures and protrusions engage. For example, the two protrusions may comprise two tabs, and the two apertures may comprise two slots. Such tabs and slots can engage and lock via rotation of the luminaire relative to the bracket, for example.

The foregoing discussion of luminaire mounting is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

BRIEF DESCRIPTION OF THE FIGURES

Reference will be made in the below discussion to the accompanying drawings, in which.

Figure 1:
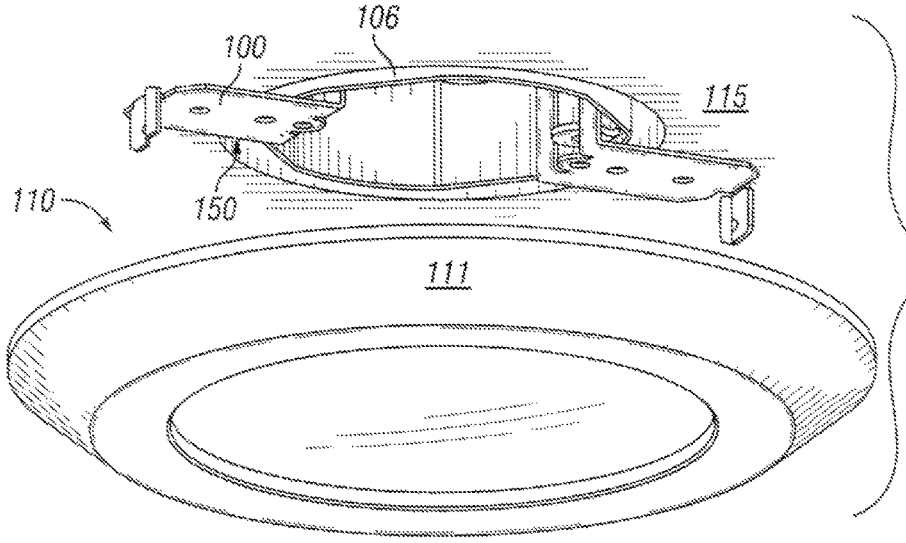
FIG. 1 illustrates a perspective view of a mounting bracket installed to a junction box and a luminaire below a ceiling in accordance with an example embodiment of the disclosure.

Many aspects of the technology can be better understood with reference to the above drawings. The elements and features shown in the drawings are not necessarily to scale, emphasis being placed upon clearly illustrating the principles of exemplary embodiments of the present technology. Moreover, certain dimensions may be exaggerated to help visually convey such principles.

DETAILED DESCRIPTION OF EXAMPLE EMBODIMENTS

Embodiments of the disclosure are directed to systems, methods, and devices for connecting a luminaire to a junction box or other member. The systems and methods described herein may provide multiple advantages. Some embodiments provide installation of a luminaire to a junction box or other structure using mounting components that are hidden from view once the luminaire is installed. Some embodiments provide installation without custom tools to remove elements of the luminaire, such as lens, that are visible after installation. Some embodiments facilitate installation alternatives supporting a variety of luminaire types.

Embodiments of the disclosure now will be described more fully hereinafter with reference to the accompanying drawings, in which embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to elements that are like, but not necessarily identical, throughout.

Figure 7:
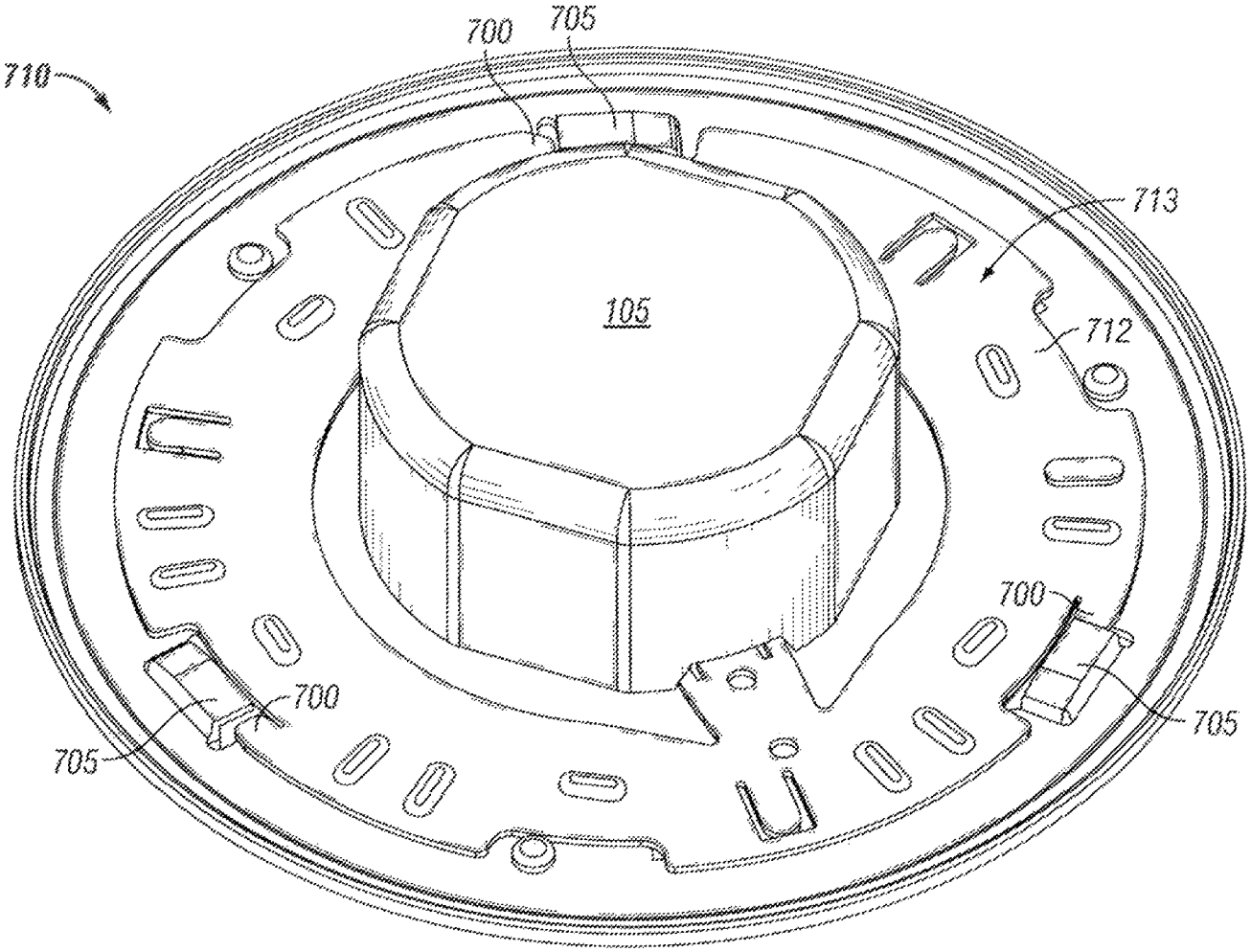
FIG. 7 illustrates a perspective view of mounting bracket tabs not yet engaged with luminaire receivers in accordance with an example embodiment of the disclosure.
Figure 8:
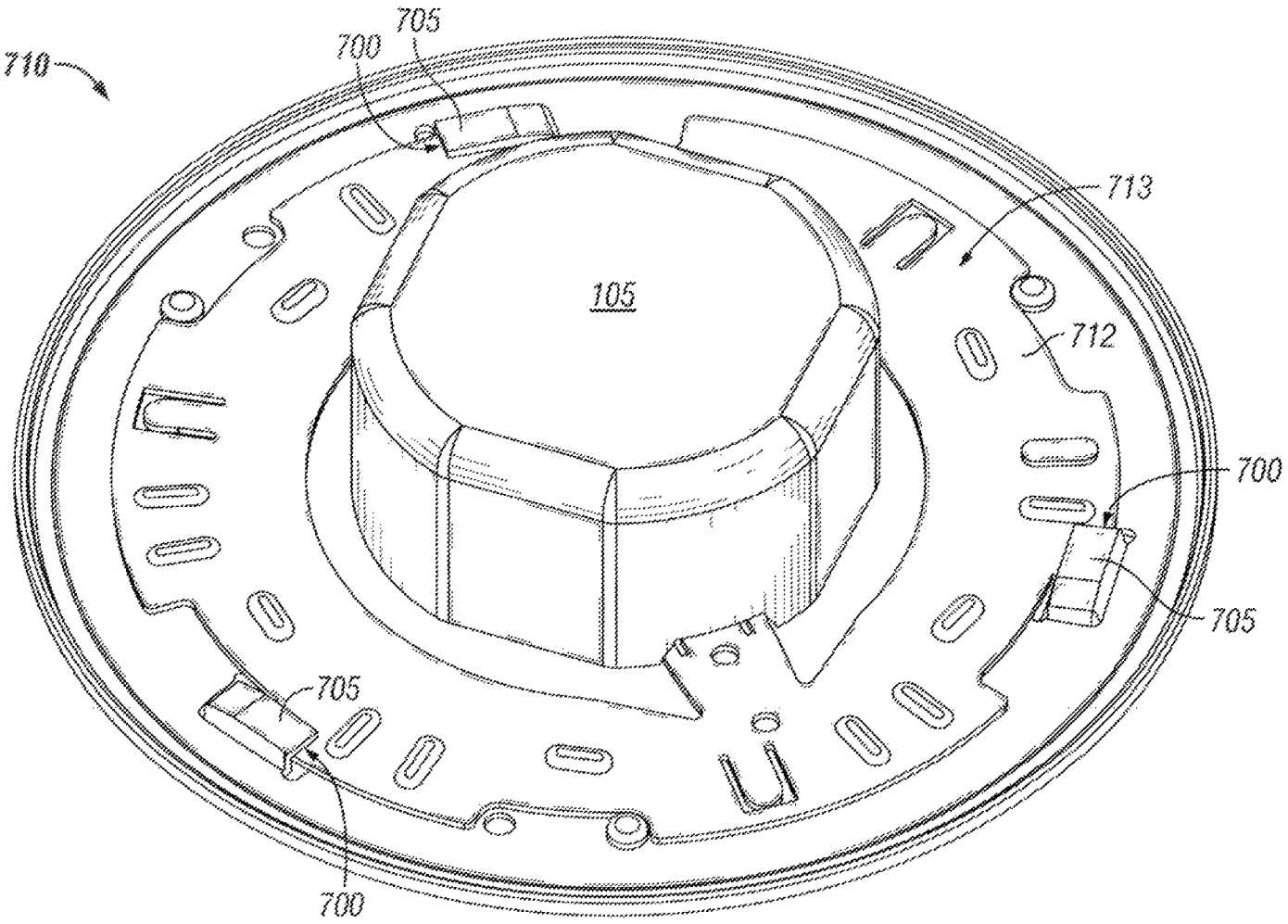
FIG. 8 illustrates a perspective view of mounting bracket tabs engaged with luminaire receivers in accordance with an example embodiment of the disclosure.

FIGS. 1-6 illustrate representative features for a first example embodiment. FIGS. 7 and 8 illustrate representative features for a second embodiment. FIGS. 9-19 illustrate representative features for some embodiments that utilize a two-tab mounting bracket and are similar to the first example embodiment from FIGS. 1-6. FIGS. 20-32 illustrate representative features for some embodiments utilizing a three-tab mounting bracket.

Some example embodiments in accordance with FIGS. 1-6 will now be discussed.

FIG. 1 illustrates a perspective view of a mounting bracket 100 installed to a junction box 105 and an uninstalled luminaire 110 below a ceiling 115 in accordance with an example embodiment of the disclosure. In a typical installation, the junction box 105 is mounted in or above a hole 150 in the ceiling 115 using nails, screws, fasteners, hangar bars, friction springs or brackets, or other appropriate mounting system. As will be discussed in further detail below, the mounting bracket 100 attaches to the junction box 105, and the luminaire 110 attaches conveniently to the mounting bracket 100.

The example mounting bracket 100 shown in FIG. 1 is shaped to accommodate low profile luminaires 110. As shown in FIG. 1, one example luminaire 110 may have a large diameter and non-removable parts (e.g., a lens, trim, etc.) that would be visible after installation. In the illustrated embodiment, a center portion of the mounting bracket 100 is sized for insertion in the hole 150, while another, outer portion protrudes from the hole 150 and is sized so that its insertion in the hole is obstructed in the intended orientation. In the illustrated embodiment, the luminaire 110 is also sized larger than the hole 150.

The mounting bracket 100 may be shaped as appropriate for various luminaire shapes including various low profile luminaires, such as the luminaire 110 shown in FIG. 1. Once the luminaire 110 is installed to the mounting bracket 100 the mounting bracket 100 is not visible from below the installed luminaire 110, and in the illustrated embodiment, is hidden behind a circumscribing rim 111 of the luminaire 110.

Figure 2:
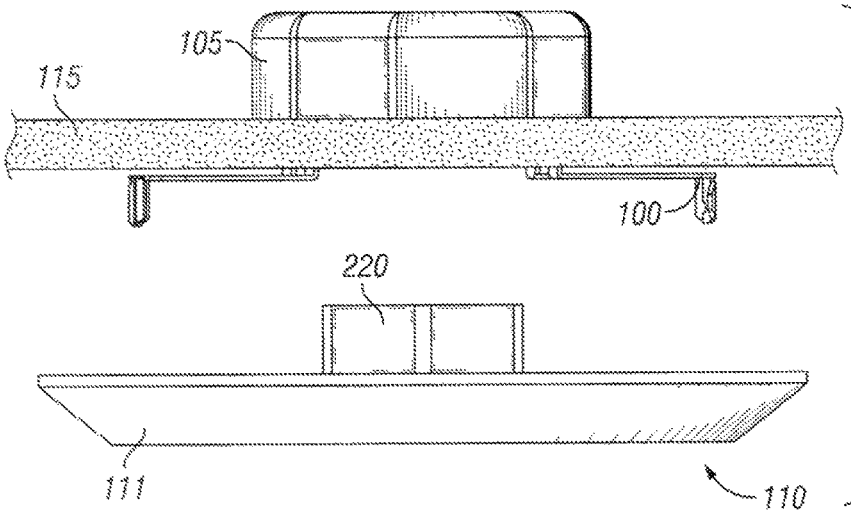
FIG. 2 illustrates a side view of a mounting bracket installed to a junction box and an uninstalled luminaire below a ceiling in accordance with an example embodiment of the disclosure.

FIG. 2 illustrates a side view of the mounting bracket 100 installed to the junction box 105 and the uninstalled luminaire 110 below the ceiling 115 in accordance with an example embodiment of the disclosure. As shown in FIG. 2, a power system 220 may be located on the back of the luminaire 110. The power system 220 may comprise power circuitry, a power enclosure, or other protruding enclosure or element of the luminaire 110, such as a driver for a luminaire based on light emitting diode (LED) technology.

The mounting bracket 100 may be shaped to accommodate such a power system 220 or other protruding features located on the back of the luminaire 110. This space clearance provided by the shaping of the mounting bracket 100 provides a receptacle and supports the junction box 105 housing components such as the power system 220 in the junction box 105. More particularly, the mounting configuration of FIG. 2 can be viewed as nested, with the power system 220 disposed in a receptacle of the mounting bracket 100, and the receptacle of the mounting bracket 100 disposed in the junction box 105.

In addition to functional benefits, the illustrated configuration can provide an aesthetically pleasing installed luminaire 110 as viewed from below the ceiling 115. In some example embodiments, such accommodation of protruding features on the back of the luminaire 110 facilitates an installation of the luminaire 110 that is flush or nearly flush to the bottom of the ceiling 115.

Figure 3:
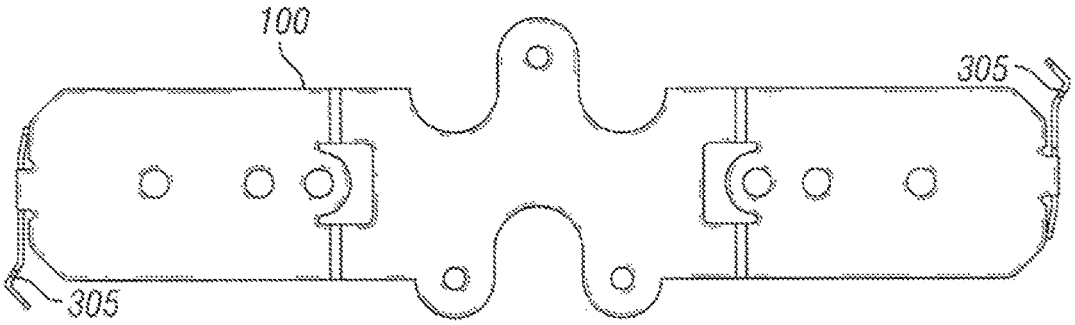
FIG. 3 illustrates a mounting bracket with two locking tabs in accordance with an example embodiment of the disclosure.

FIG. 3 illustrates the mounting bracket 100 with two mounting tabs 305 that lock in accordance with an example embodiment of the disclosure. As shown in FIG. 3, the example mounting bracket 100 has two mounting tabs 305 that engage with a back portion of the luminaire 110 when the luminaire 110 is lifted into position. In various embodiments, the engagement may comprise mating with, locking into, pushing against, snapping, plugging, a slot-and-tab connection, or some other appropriate form of mechanical linkage, connection, or fastening.

With the example mounting bracket 100 shown in FIG. 3, the luminaire 110 is rotated to engage the mounting tabs 305 with features located on the luminaire 110, examples of which will be described in further detail below with reference to additional figures. In various embodiments of the disclosure, other mounting brackets may have more or less than two mounting tabs 305. For instance, some bracket embodiments may have three mounting tabs. The mounting bracket 100 may be made out of stamped metal or a variety of other appropriate materials (for example, die castings, plastic, steel, or other materials).

Figure 4:
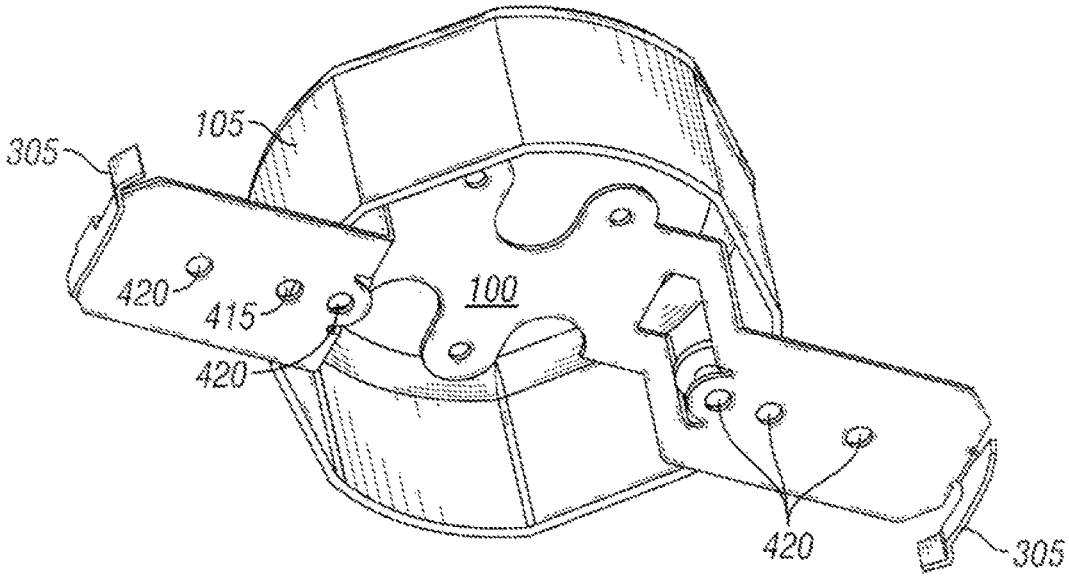
FIG. 4 illustrates a perspective view of a mounting bracket with two locking tabs installed to a junction box in accordance with an example embodiment of the disclosure.

FIG. 4 illustrates a perspective view of a mounting bracket 100 with two mounting tabs 305 installed to the junction box 105 in accordance with an example embodiment of the disclosure. As shown in FIG. 4, the mounting bracket 100 may be attached to the junction box 105 with one or more fasteners, for example screws, rivets, pins, clips, or other appropriate devices, via fastener holes 415, 420 located in the mounting bracket 100.

As shown in FIG. 4, the mounting bracket 100 may have multiple fastener holes 415 to accommodate existing receiving means (for example screw holes, etc.) on the junction box 105, or to allow for new attachments to be made to portions of the junction box 105. With such flexibility, the mounting bracket 100 can accommodate junction boxes 105 of various shapes and sizes, junction boxes 105 made of various materials (for example metal, plastic, etc.), or junction boxes 105 used in new construction or remodeling. Additionally, the mounting bracket 100 may be attached to other structures mounted at, in, or above the ceiling 115.

The bends provided in the mounting bracket 100 shown in FIG. 4 facilitate placing portions of the mounting bracket 100 inside the junction box 105 above the ceiling plane. Thus, the installed bracket 100 provides space clearance to receive a portion of the luminaire 110 that may be protruding from the back side of the luminaire 110, for example a power supply 220, such as a driver for an LED-based luminaire. Additionally, this space may retain house wiring towards the back of the junction box 105 to aid in installation by providing clearance.

In alternative embodiments to the single piece construction shown in FIG. 4, the mounting bracket 100 can be made of multiple pieces or various materials, for example, the mounting tabs 305 may be separate from the mounting bracket 100 and/or made of different material than the other portions of the mounting bracket 100.

Figure 5:
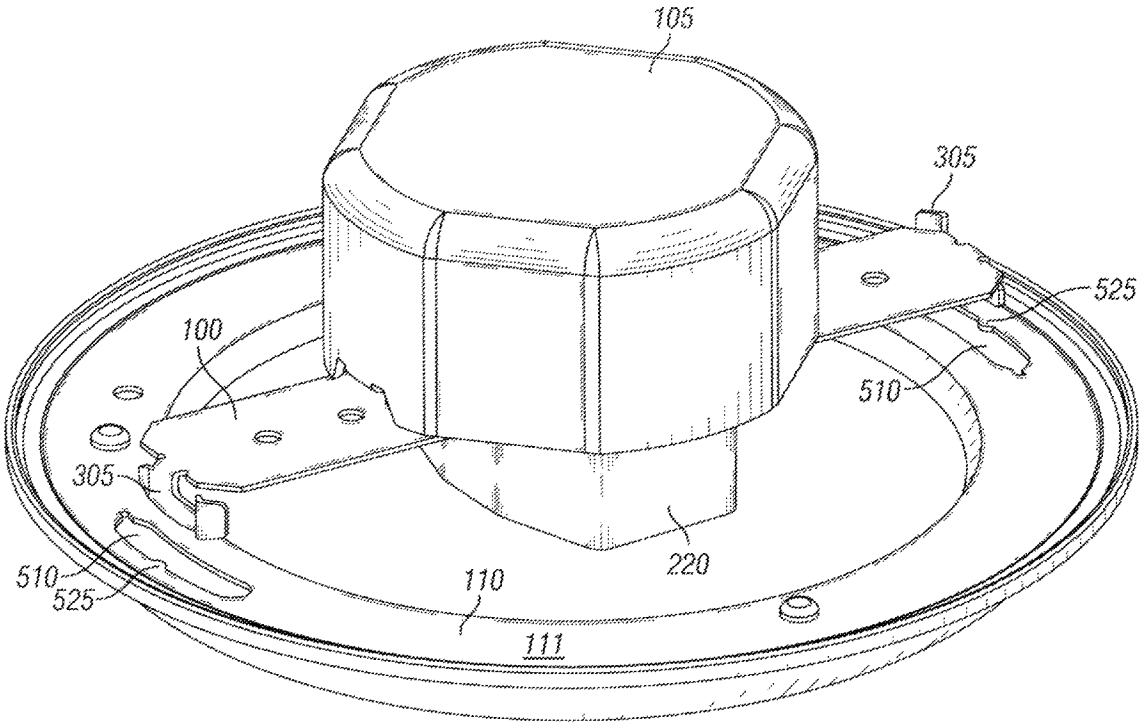
FIG. 5 illustrates a perspective view of a mounting bracket installed to the junction box and luminaire slots aligned with the mounting bracket locking tabs in accordance with an example embodiment of the disclosure.

FIG. 5 illustrates a perspective view of the mounting bracket 100 installed to the junction box 105 with the luminaire 110 positioned so that luminaire slots 510 are aligned with the bracket mounting tabs 305 in accordance with an example embodiment of the disclosure. As shown in FIG. 5, the bracket mounting tabs 305 fit into slots 510 located on the back of the luminaire 110, specifically on a rear side of the rim 110 the luminaire 110.

In the illustrated embodiment, when the luminaire 110 is rotated, the bracket mounting tabs 305 slide past a locking feature 525 (in this example a protrusion or bump) on the profile of the slot 510 to lock the luminaire 110 into place and may hinder the luminaire 110 from rotating back. In the embodiment of the disclosure shown in FIG. 5, the angles on the bracket mounting tab 305 and locking feature 525 facilitate disassembly, for example in connection with servicing the luminaire 110. The luminaire 110 may be uninstalled by rotating the luminaire 110 back by hand or otherwise.

Accordingly, the luminaire 110 can be installed to the mounting bracket 100 without necessarily removing any lens or other covering of the luminaire 110, and the fastening system is hidden. Similarly, the luminaire 110 can be readily removed from the mounting bracket 100 without necessarily disassembly of the luminaire 110.

In alternative embodiments, the engagement between the mounting bracket 100 and luminaire 110 may be reversed with the mounting bracket 100 containing the slots 510 and the luminaire 110 containing the mounting tabs 305, while still supporting rotation of the luminaire 110 for slot-tab engagement to fix the luminaire 110 in place.

Figure 6:
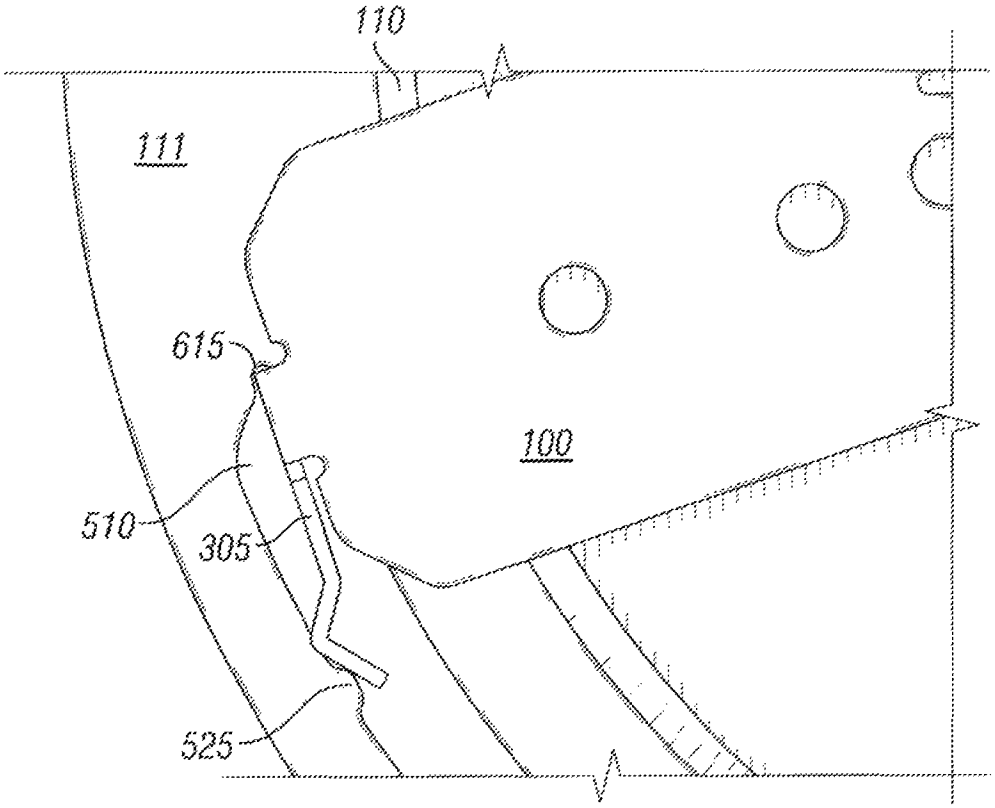
FIG. 6 illustrates a mounting bracket tab in a representative locked position in a luminaire slot in accordance with an example embodiment of the disclosure.

FIG. 6 illustrates the bracket mounting tab 305 in locked position in the luminaire slot 510 in accordance with an example embodiment of the disclosure. As shown in the example embodiment of FIG. 6, when the luminaire 110 is rotated in relation to the bracket 100, the luminaire 110 becomes held or locked in place. A locking feature 535 of the luminaire slot 510 engages with a bend 603 of the bracket mounting tab 305 located towards one end of the mounting bracket tab 305. A notch 615 of the luminaire slot 510 further engages with another portion of the bracket mounting tab 305.

In one example embodiment of the disclosure, when the luminaire 110 is rotated in relation to the mounting bracket 100, the bracket mounting tab 305 is guided to the correct installation position in the luminaire slot 510 based on the length between the notch 615 and locking feature 525 of the slot 510 and/or the shape of the perimeter of the slot 510. As installed, the luminaire 110 is centered on the mounting bracket 100 when installed. Other configurations of the bracket mounting tab 305 or luminaire slot 510 may be used in alternative embodiments of the disclosure to create other mating or locking relationships between a protrusion such as the tab 305 and an aperture such as the slot 510 when the luminaire 110 is rotated in relation to the mounting bracket 100 during installation.

Some example embodiments in accordance with FIGS. 7 and 8 will now be discussed.

Whereas the example mounting bracket 100 illustrated in FIGS. 1-6 has two opposing arms, each with a radially disposed bracket mounting tab 305, the mounting bracket 713 in the embodiment of FIGS. 7 and 8 comprises a disk 712 with three radially disposed bracket mounting tabs 700.

FIG. 7 illustrates a perspective view of the bracket mounting tabs 700 aligned to but not yet engaged with luminaire receivers 705. In a typical embodiment, the each tab 700 comprises a protrusion, and each receiver 705 comprises an aperture.

When the luminaire 710 is rotated, the receivers 705 engage with the bracket mounting tabs 700 to friction hold or lock the luminaire in place. FIG. 8 illustrates a perspective view of the bracket mounting tabs 700 engaged with the luminaire receivers 705 in accordance with an example embodiment of the disclosure.

In alternative embodiments, the engagement between the mounting bracket 713 and the luminaire 710 may be reversed with the mounting bracket 713 containing the receivers 705 and the luminaire 710 containing the mounting tabs 700. In such an alternative configuration (among other alternatives), rotation of the luminaire 710 causes the receivers 705 and tabs 700 to engage and fix the luminaire 710 in place.

Some example embodiment utilizing a two-tab mounting bracket will now be described with reference to FIGS. 9-19.

Figure 9:
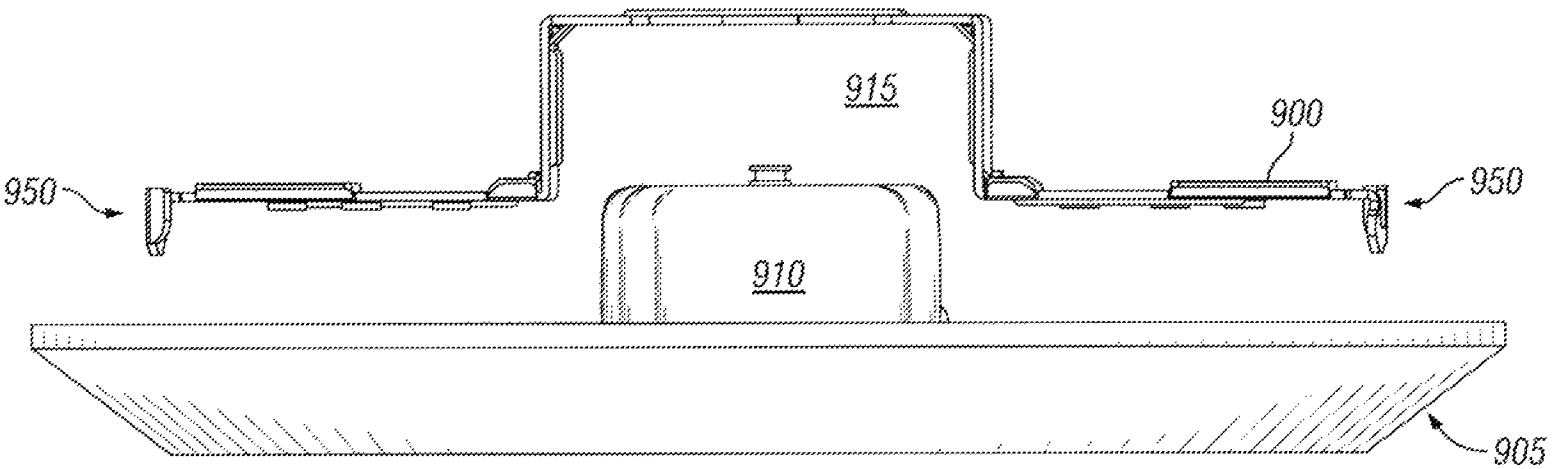
FIG. 9 illustrates a side view of a two-tab mounting bracket and associated luminaire in accordance with an example embodiment of the disclosure.

FIG. 9 illustrates a side view of a two-tab mounting bracket 900 and associated luminaire 905 in accordance with an example embodiment of the disclosure. The luminaire 905 comprises a power supply 910 that fits in a receptacle 915 of the mounting bracket 900 when the luminaire 905 is attached to the mounting bracket 900. The mounting bracket 900 further comprises mounting tabs 950 that fasten with corresponding fasteners in the luminaire 905, specifically receptacles comprising slots, as discussed above with reference to FIGS. 1-8.

Figure 10:
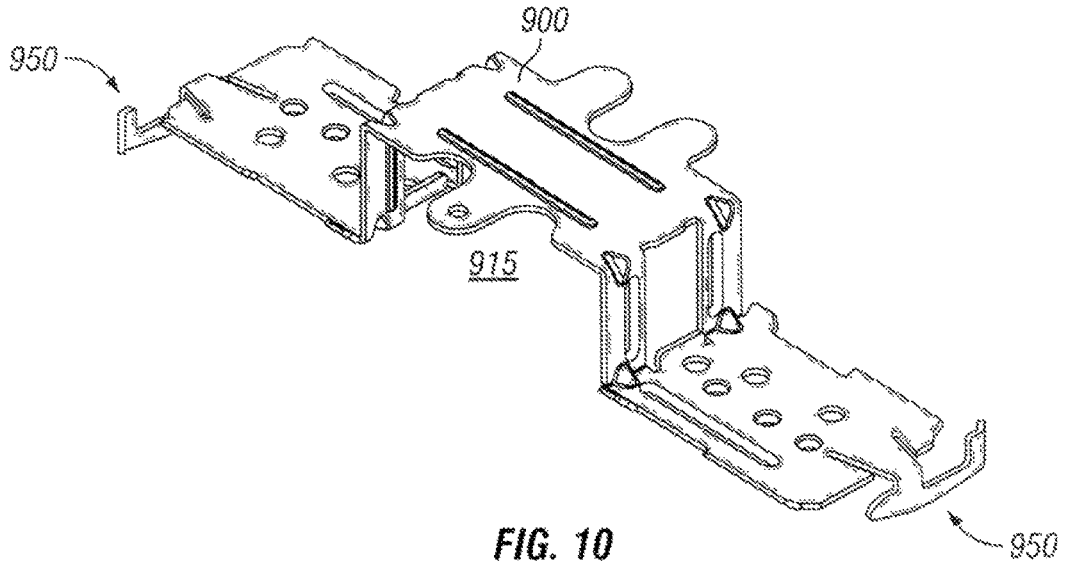
FIG. 10 illustrates a perspective view of a two-tab mounting bracket in accordance with an example embodiment of the disclosure.
Figure 11:
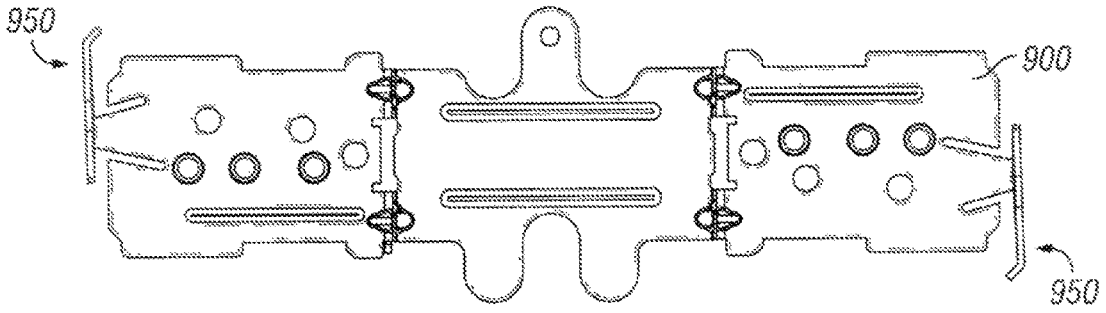
FIG. 11 illustrates a bottom view of a two-tab mounting bracket in accordance with an example embodiment of the disclosure.

FIG. 10 illustrates a perspective view of the two-tab mounting bracket 900 in accordance with an example embodiment of the disclosure. FIG. 11 illustrates a bottom view of the two-tab mounting bracket 900 in accordance with an example embodiment of the disclosure. The views of FIGS. 10 and 11 further illustrate example features of the two-tab mounting bracket illustrated in FIG. 9, including the features discussed above. Additionally, FIGS. 9 and 10 illustrate holes and apertures that facilitate utilizing the mounting bracket 900 in a variety of applications and configurations. For example, the slots facilitate mounting hardware and fasteners at multiple places and orientations to provide flexibility and promote convenient usability during installation and in connection with post-installation service.

Figure 12:
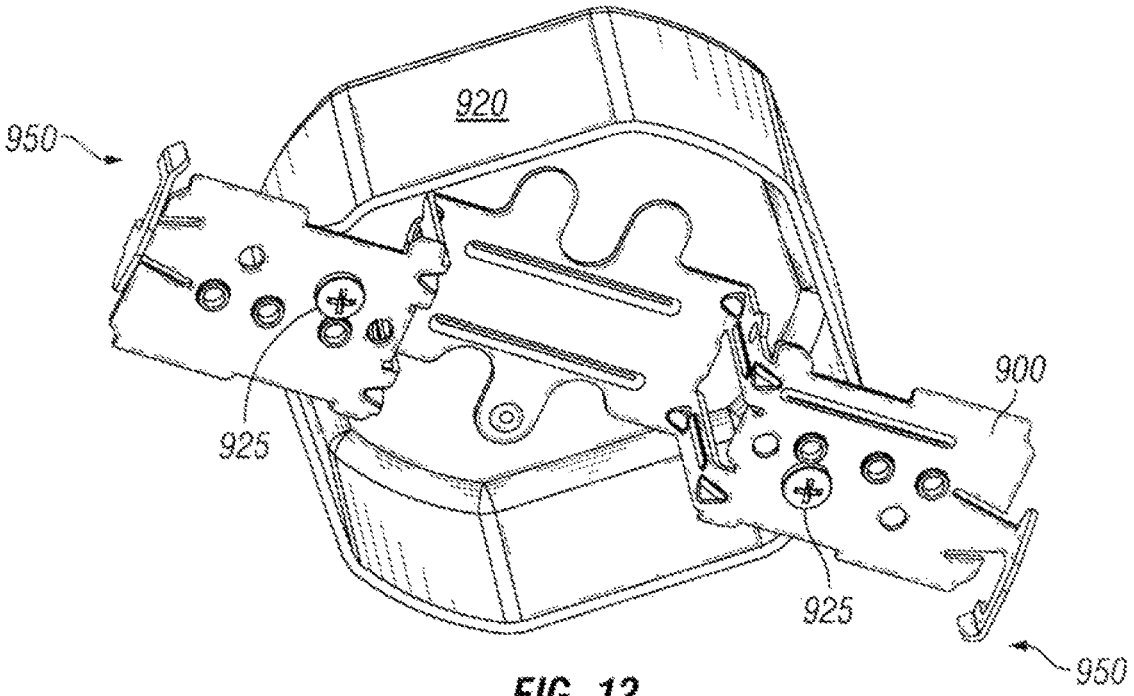
FIG. 12 illustrates a perspective view of a two-tab mounting bracket attached to a metal junction box in accordance with an example embodiment of the disclosure.

FIG. 12 illustrates a perspective view of the two-tab mounting bracket 900 attached to a metal junction box 920 in accordance with an example embodiment of the disclosure. In the illustrated embodiment, the mounting bracket 900 is attached to the junction box 920 with fasteners, in this example phillips-head screws. Other fasteners may comprise rivets, clips, pins, adhesives, etc. With the mounting bracket 900 fastened to the junction box 920, the luminaire 905 can be readily mounted to the bracket 900.

Figure 13:
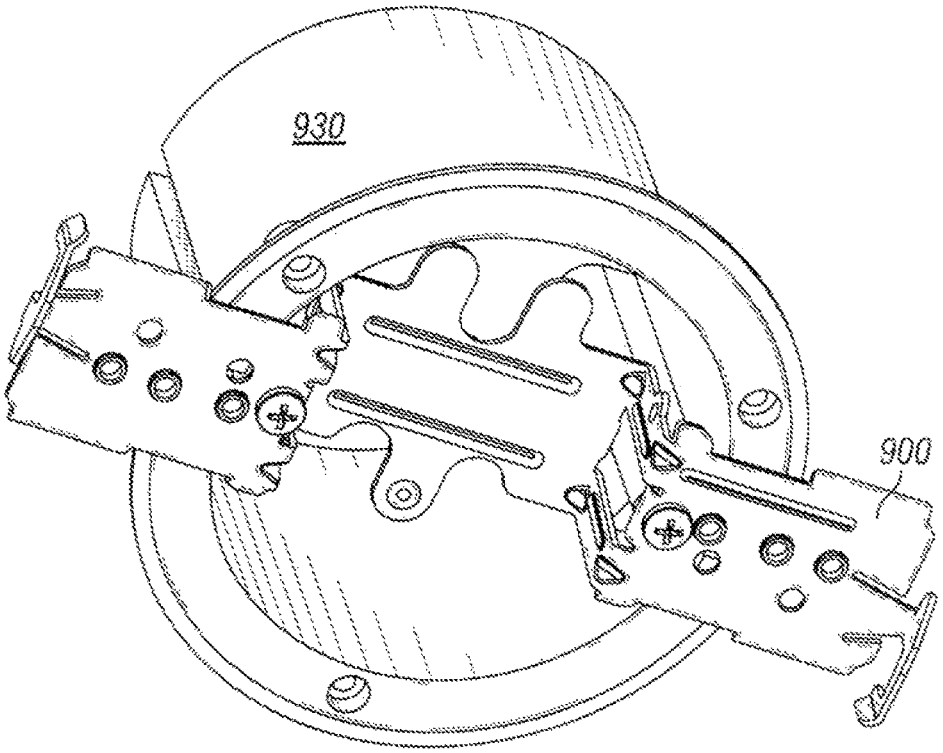
FIG. 13 illustrates a perspective view of a two-tab mounting bracket attached to a plastic junction box for recessed lighting in accordance with an example embodiment of the disclosure.

FIG. 13 illustrates a perspective view of the two-tab mounting bracket 900 attached to a plastic junction box 930 for recessed lighting in accordance with an example embodiment of the disclosure. As discussed above, the mounting bracket 900 comprises multiple holes and slots to facilitate mounting to different structures, including the plastic junction box 930 illustrated in FIG. 13 and the metal junction box 920 illustrated in FIG. 12 and discussed above.

Figure 14:
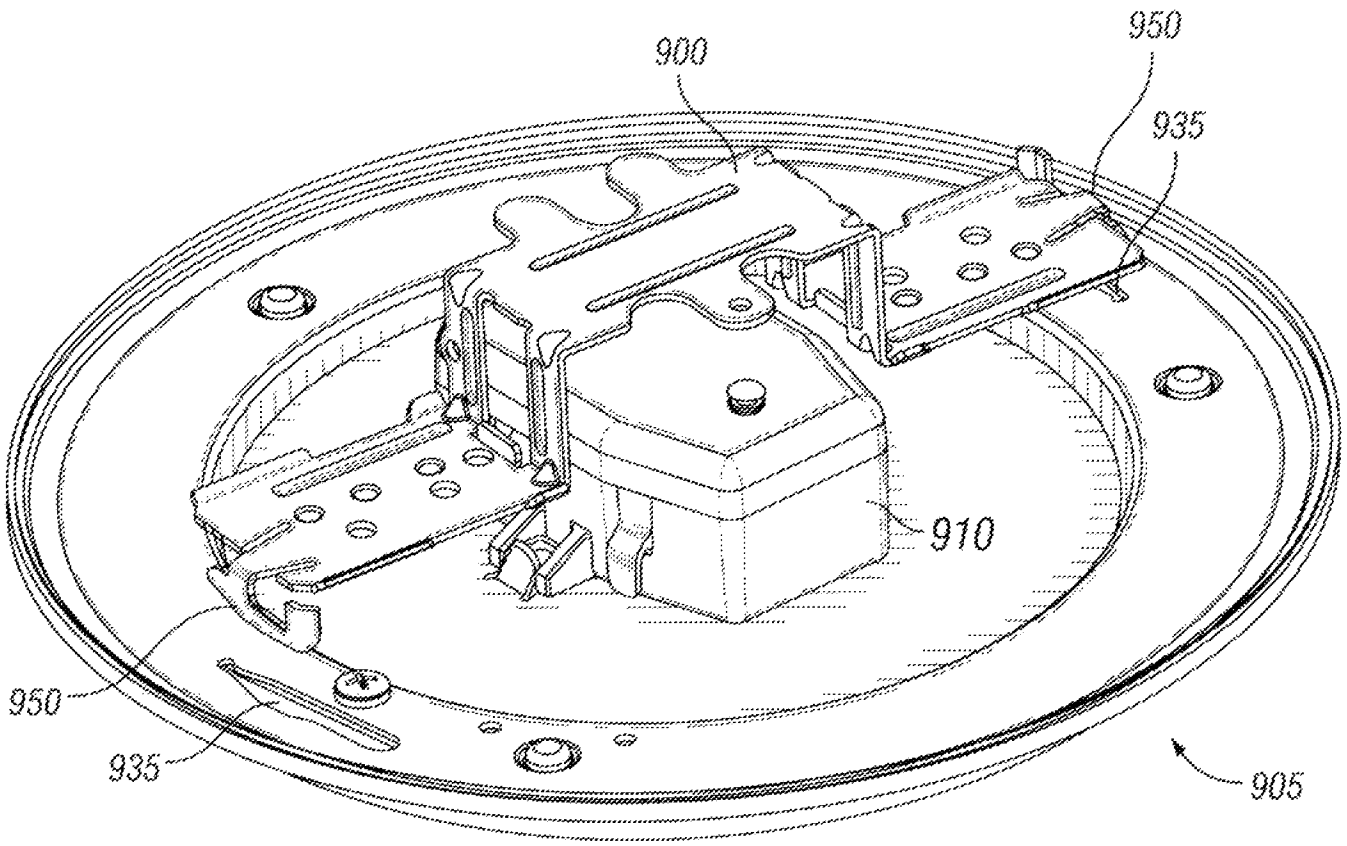
FIG. 14 illustrates a perspective view of a two-tab mounting bracket and a luminaire oriented for attachment to the mounting bracket in accordance with an example embodiment of the disclosure.

FIG. 14 illustrates a perspective view of the two-tab mounting bracket 900 and a luminaire 905 oriented for attachment to the mounting bracket 900 in accordance with an example embodiment of the disclosure. In the illustrated configuration, the bracket 900 is centered over the power system 910 of the luminaire 905, and the mounting tabs 950, are radially disposed and are aligned with slots 935 in the luminaire 905 that will receive and fasten to the mounting tabs 950.

Figure 15:
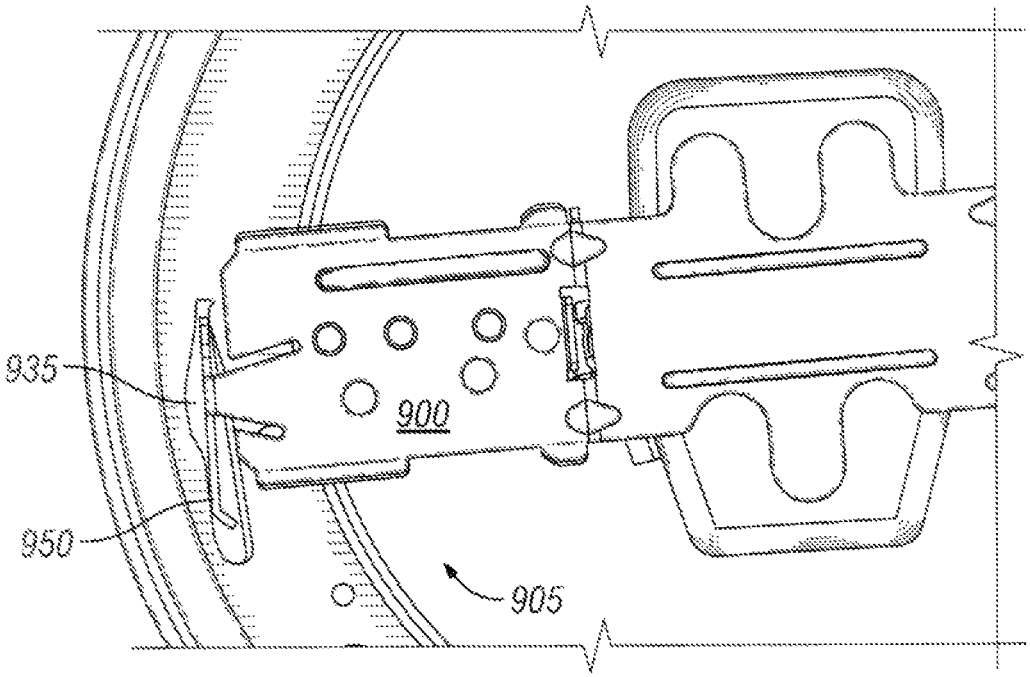
FIG. 15 illustrates a detail view of a luminaire aligned and positioned for fastening to a two-tab mounting bracket in accordance with an example embodiment of the disclosure.

FIG. 15 illustrates a detail view of the luminaire 905 aligned and positioned for fastening to the two-tab mounting bracket 900 in accordance with an example embodiment of the disclosure. More particularly, FIG. 15 illustrates the result of raising the luminaire 905 relative to the position shown in FIG. 14, so that the mounting tabs 950 are disposed in the slots 935.

Figure 16:
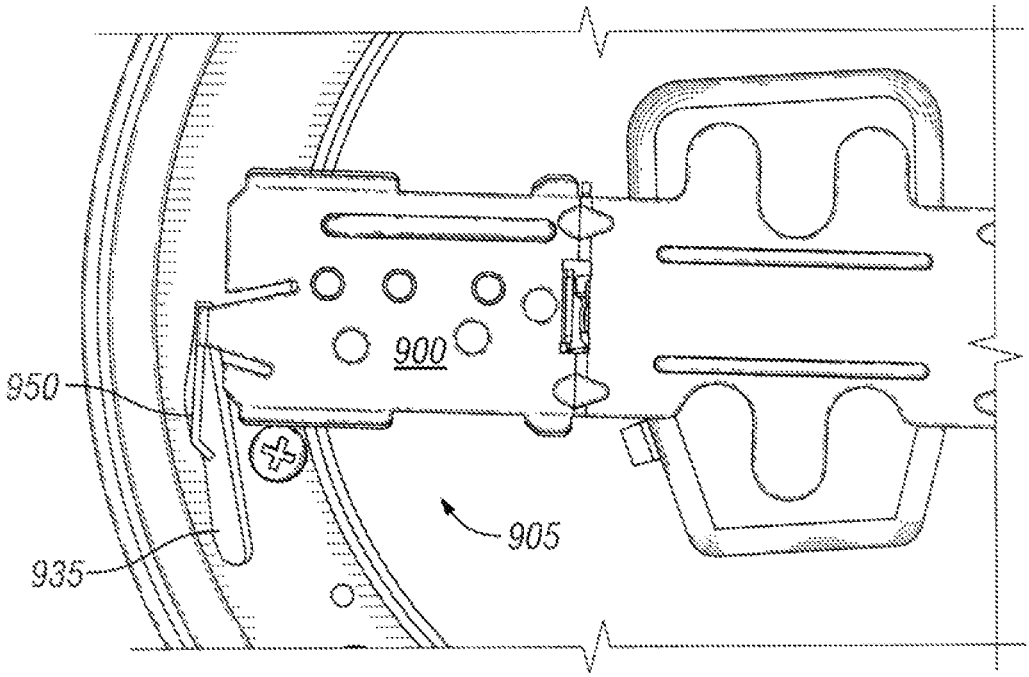
FIG. 16 illustrates a detail view of a luminaire fastened to a mounting bracket in a locked position in accordance with an example embodiment of the disclosure.

FIG. 16 illustrates a detail view of the luminaire 905 fastened to the mounting bracket 900 in a locked position in accordance with an example embodiment of the disclosure. More particularly, FIG. 16 illustrates the result of rotating the luminaire 905 about its center, vertical axis so that the mounting tabs 950 move in the slots 935 and fasten to one another, thereby locking the luminaire 905 in position in the illustrated embodiment. In this position, the luminaire 905 can be viewed as mounted in an operational state.

Figure 17:
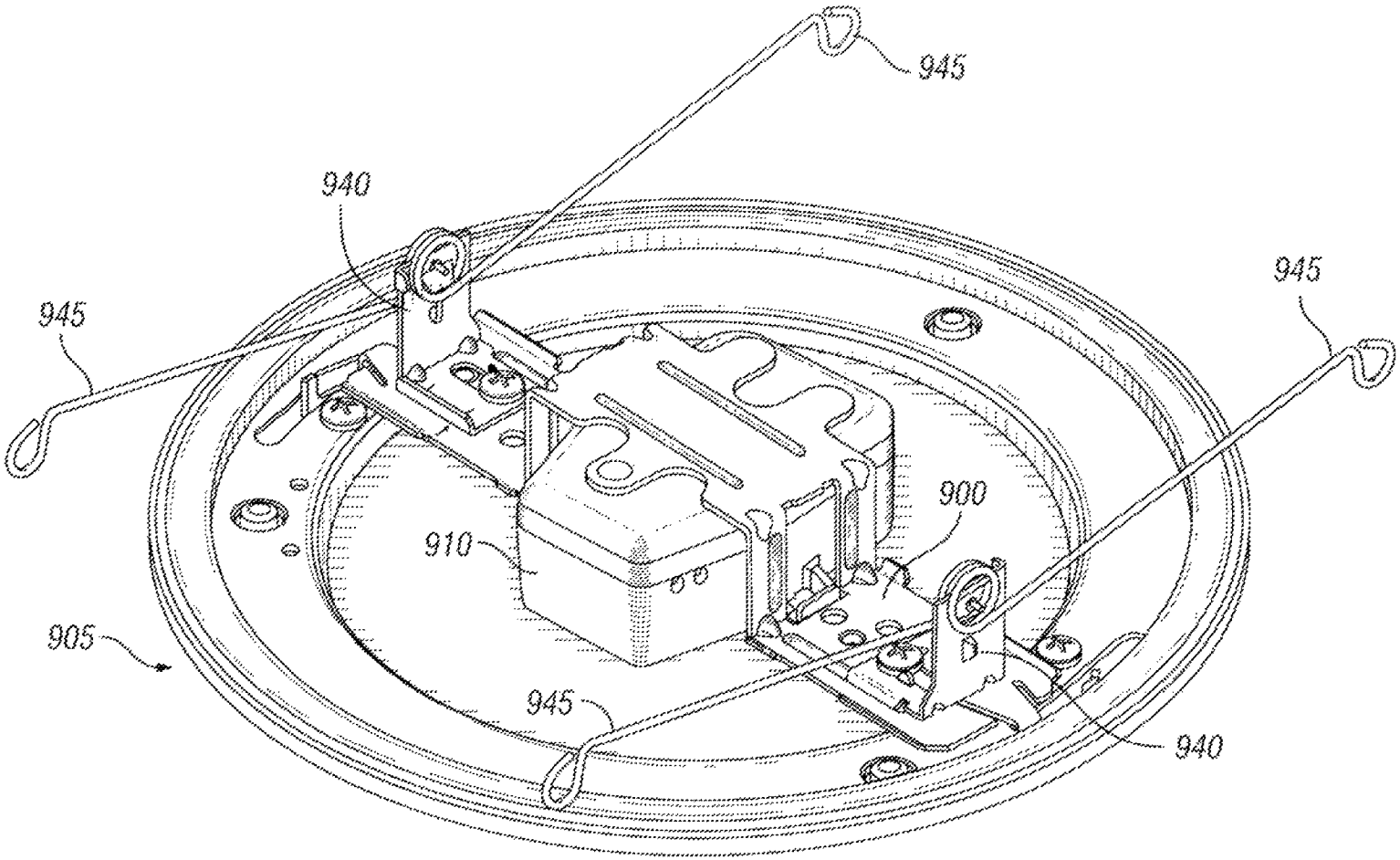
FIG. 17 illustrates a perspective view of a system in which a luminaire is attached to a two-tab mounting bracket, the mounting bracket is connected to a torsion spring, and the torsion spring is configured for attaching to a recessed housing above a ceiling in accordance with an example embodiment of the disclosure.

FIG. 17 illustrates a perspective view in which the luminaire 905 is attached to a two-tab mounting bracket 900, the mounting bracket 900 is attached to two torsion spring brackets 945, and the torsion spring brackets 945 are configured for attaching to a recessed housing above a ceiling 115 (see FIGS. 1 and 2) in accordance with an example embodiment of the disclosure.

FIG. 17 provides another example of how the illustrated mounting bracket 900 is adaptable for mounting to a diverse structures and systems. In this case, the mounting bracket 900 is attached to two torsion spring brackets 945, each of which has two associated torsion spring arms 945. The torsion spring arms 945 are configured to maintain the assembly in position in a ceiling-mount installation, or other appropriate application. The two torsion spring brackets 945 can be attached to the bracket 900 at different radial positions to accommodate different sized housings.

Figure 18:
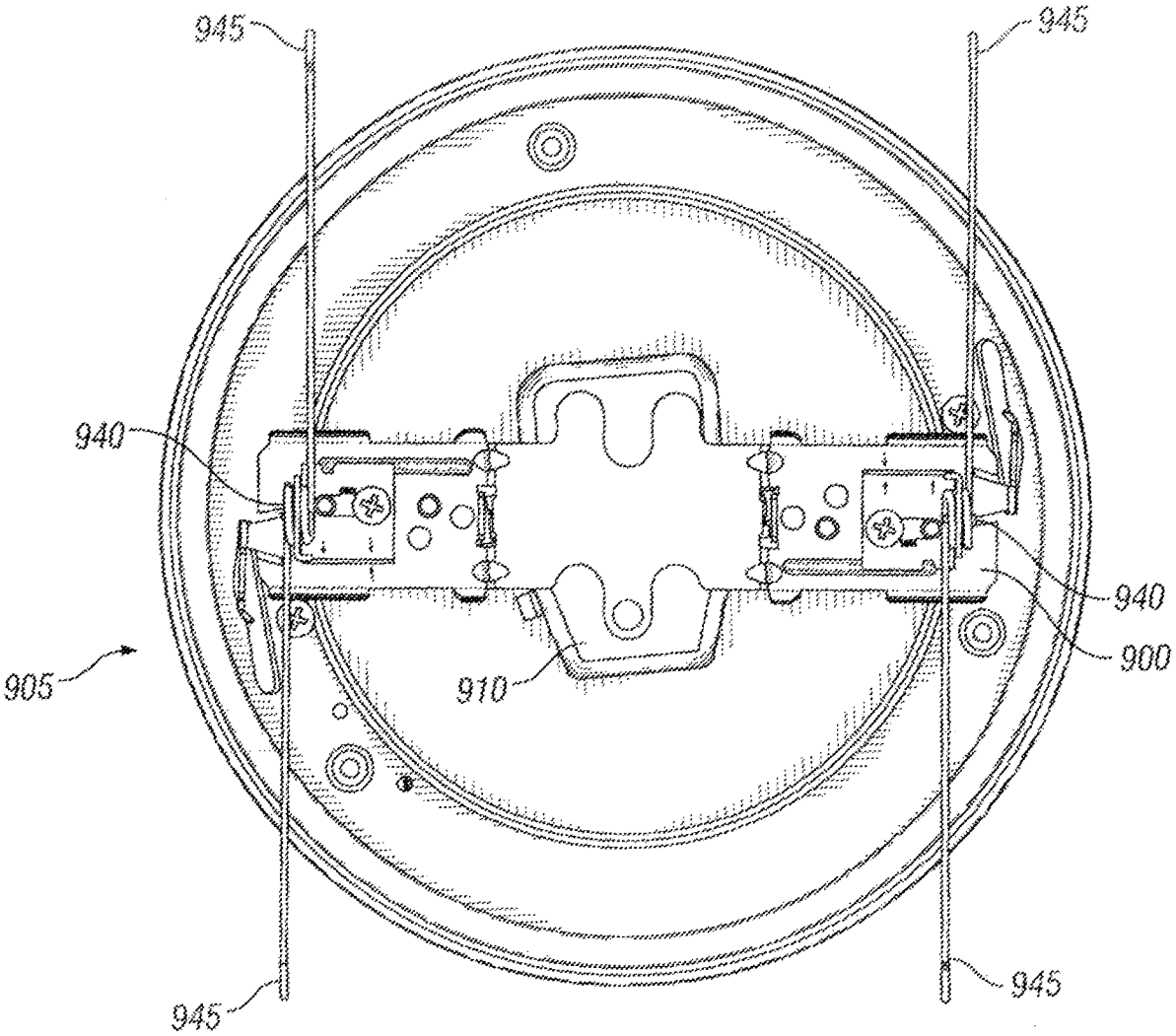
FIG. 18 illustrates a top-down view of a system in which a luminaire is attached to a two-tab mounting bracket, the mounting bracket is connected to a torsion spring bracket, and the torsion spring bracket is configured for attaching to a recessed housing above a ceiling in accordance with an example embodiment of the disclosure.

FIG. 18 illustrates a top-down view of the system in which the luminaire 905 is attached to the two-tab mounting bracket 900, the mounting bracket 900 is attached to the torsion spring brackets 945, and the torsion spring brackets are configured for attaching to a structure (not illustrated) above a ceiling 115 (see FIGS. 1 and 2) in accordance with an example embodiment of the disclosure. More specifically, FIG. 18 provides an overhead view of the assembly that FIG. 17 illustrates in perspective view, as configured for a representative installation.

Figure 19:
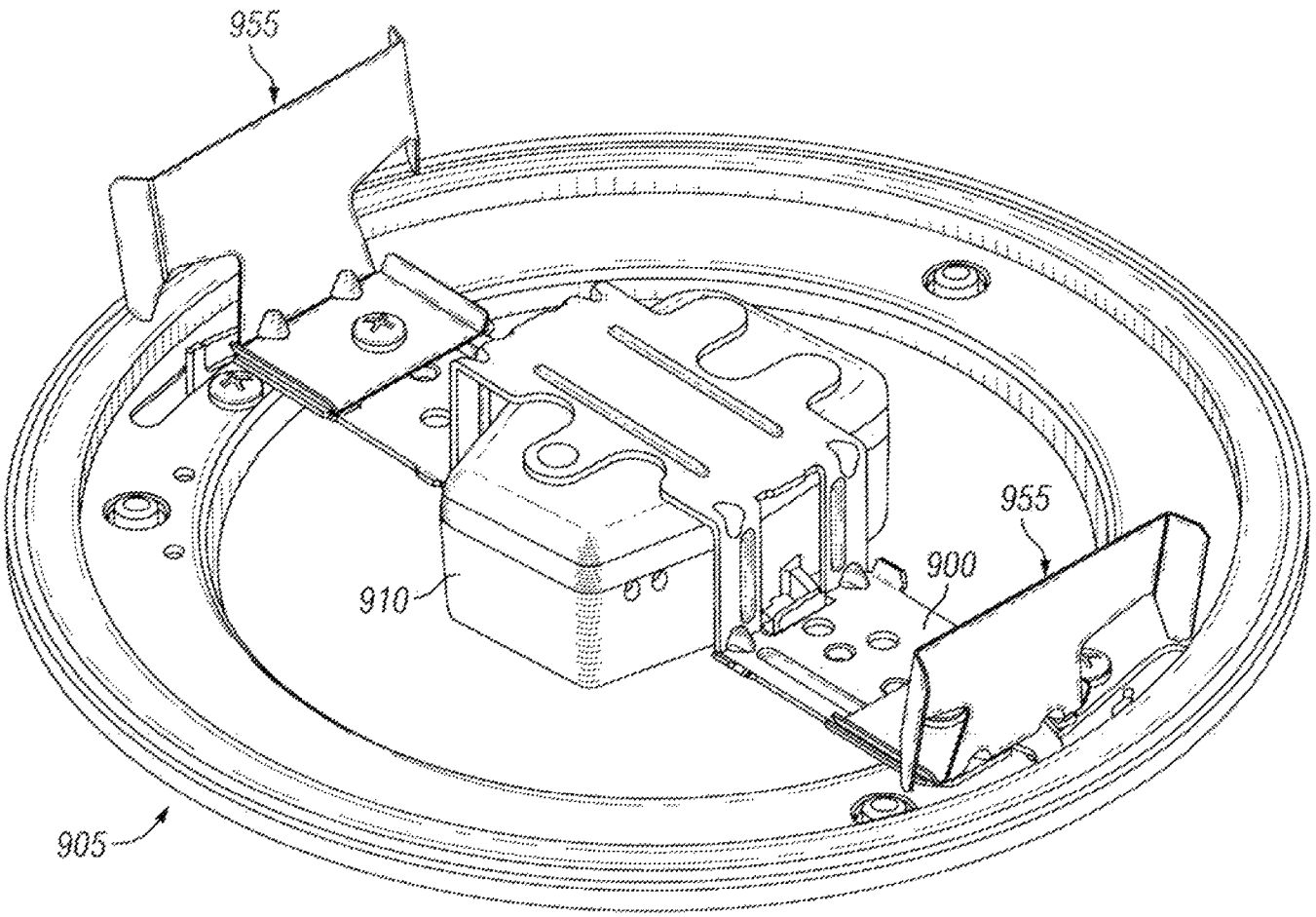
FIG. 19 illustrates a perspective view of a system in which a luminaire is attached to a two-tab mounting bracket, the mounting bracket is connected to a friction spring, and the friction spring is configured for attaching to a recessed housing above a ceiling in accordance with an example embodiment of the disclosure.

FIG. 19 illustrates a perspective view in which the luminaire 905 is attached to a two-tab mounting bracket 905, the mounting bracket 905 is connected to a friction spring, and the friction spring 955 is configured for attaching to a recessed housing above a ceiling 115 (see FIGS. 1 and 2) in accordance with an example embodiment of the disclosure. FIG. 19 thus provides another example of the range of installation configurations supported by the flexibility of the example mounting bracket 905. In this example, the friction spring 955 can be flexed for friction gripping to a structure that may be in an attic or above a ceiling, for example. The two sides of the friction spring 955 can be attached to the bracket 905 at different locations for coupling to different sized housings. The friction spring 955 can be characterized as a friction clip or as a retention spring.

Some example embodiment utilizing a two-tab mounting bracket will now be described with reference to FIGS. 20-32.

Figure 20:
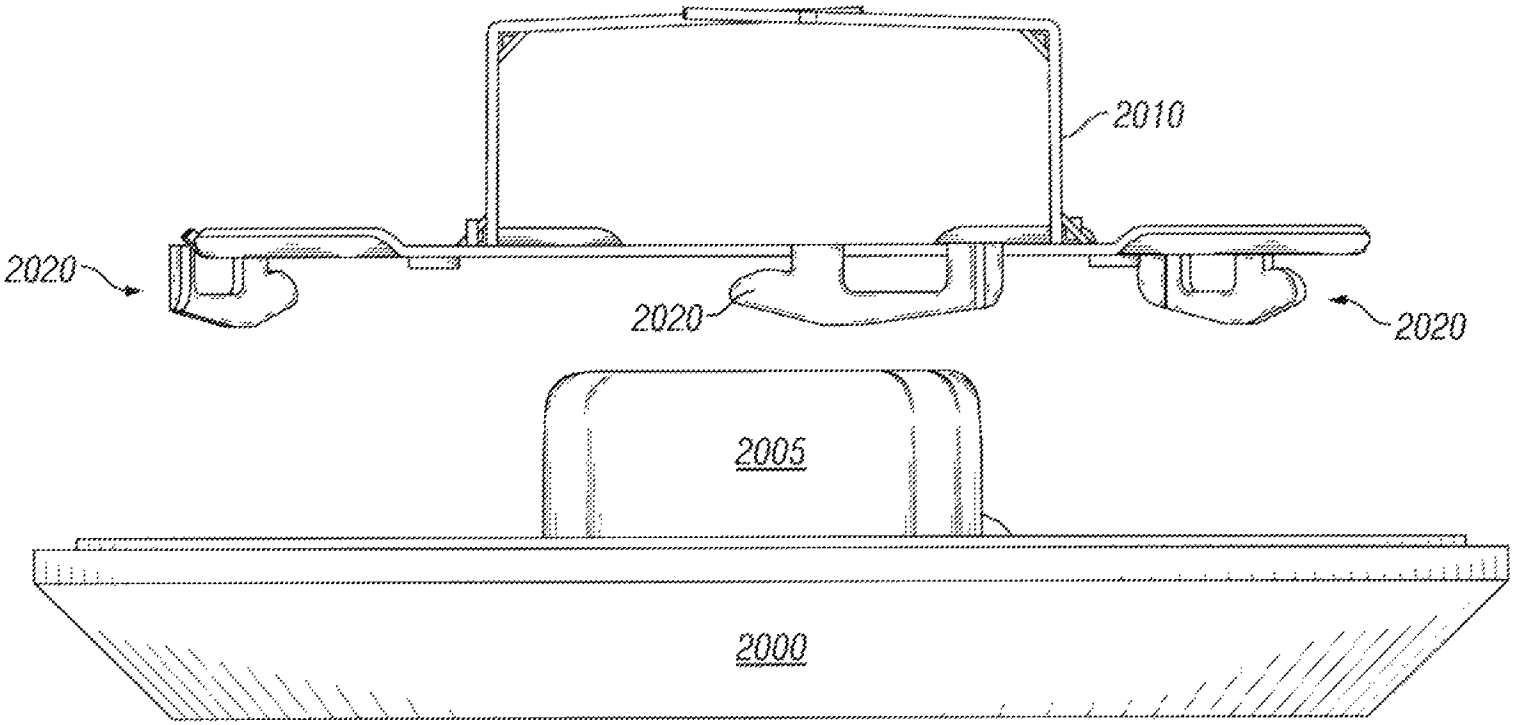
FIG. 20 illustrates a side view of a system in which a luminaire is attached to a three-tab mounting bracket in a three-point attachment in accordance with an example embodiment of the disclosure.

FIG. 20 illustrates a side view of a system in which a luminaire 2000 is attached to a three-tab mounting bracket 2010 in a three-point attachment in accordance with an example embodiment of the disclosure. As will be illustrated in further detail in subsequent figures, the luminaire 2000 comprises a power system 2005 that is disposed in a receptacle of the mounting bracket 2010, in this example a cavity or open area, when the luminaire 2000 is fastened to the mounting bracket 2010. In the illustrated embodiment, the mounting bracket 2010 comprises three mounting tabs 2020 that may be disposed at equal angular locations about the bracket center, that is with 120 degrees of separation. Other embodiments may have different angular separation and may also have more or fewer mounting tabs 2020.

Figure 21:
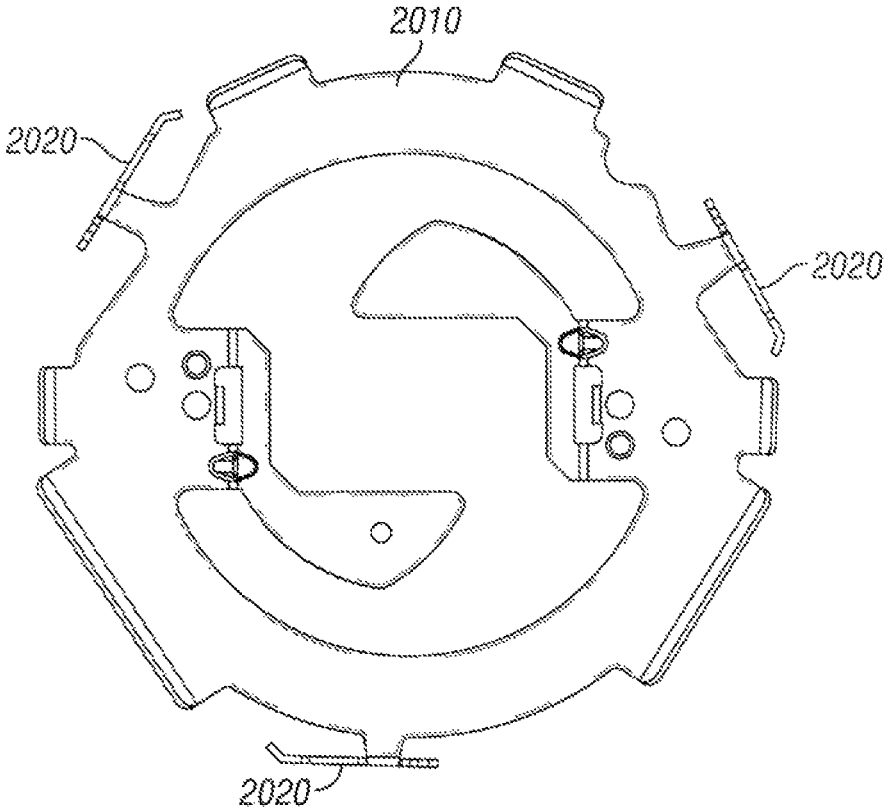
FIG. 21 illustrates a plan view of a three-tab mounting bracket that provides a three-point attachment in accordance with an example embodiment of the disclosure.
Figure 22:
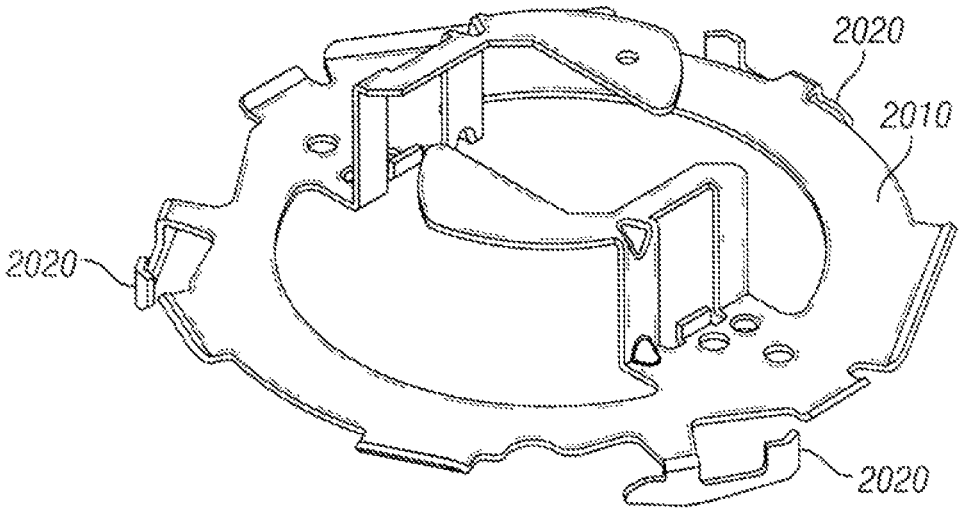
FIG. 22 illustrates a perspective view of a three-tab mounting bracket that provides a three-point attachment in accordance with an example embodiment of the disclosure.
Figure 23:
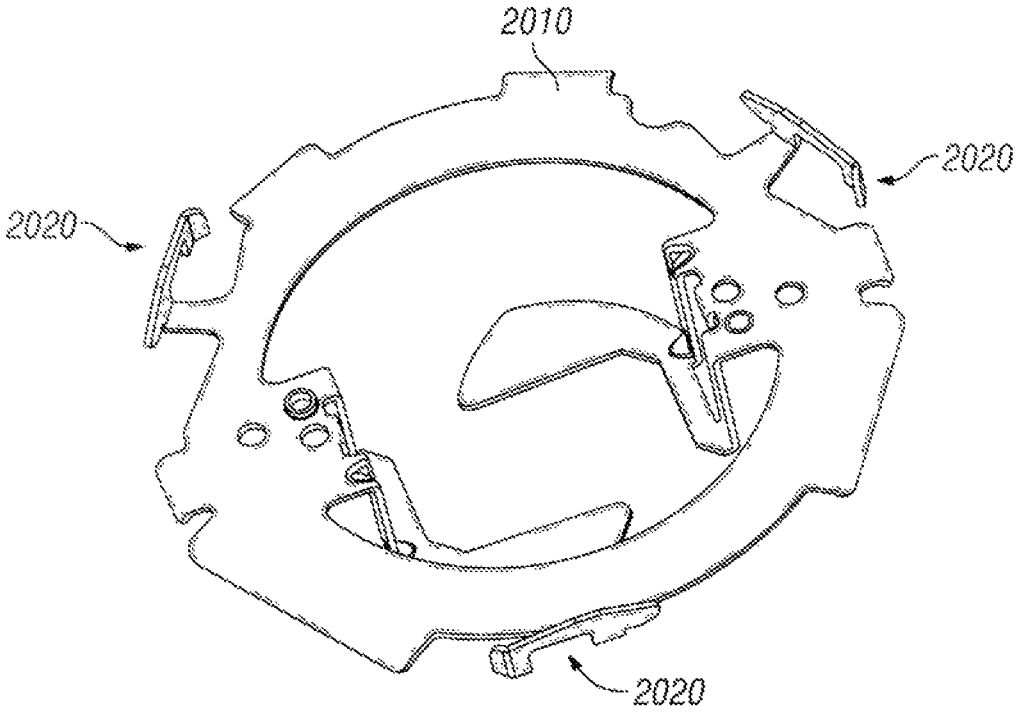
FIG. 23 illustrates a perspective view of a three-tab mounting bracket in accordance with an example embodiment of the disclosure.

FIG. 21 illustrates a plan view of the three-tab mounting bracket 2010 that provides the three-point attachment in accordance with an example embodiment of the disclosure. FIG. 22 illustrates an overhead perspective view of the three-tab mounting bracket 2010 that provides a three-point attachment in accordance with an example embodiment of the disclosure. FIG. 23 illustrates a underneath perspective view of the three-tab mounting bracket 2010 in accordance with an example embodiment of the disclosure. The three mounting tabs 2020 are visible in the illustrations of FIGS. 21, 22, and 23.

Figure 24:
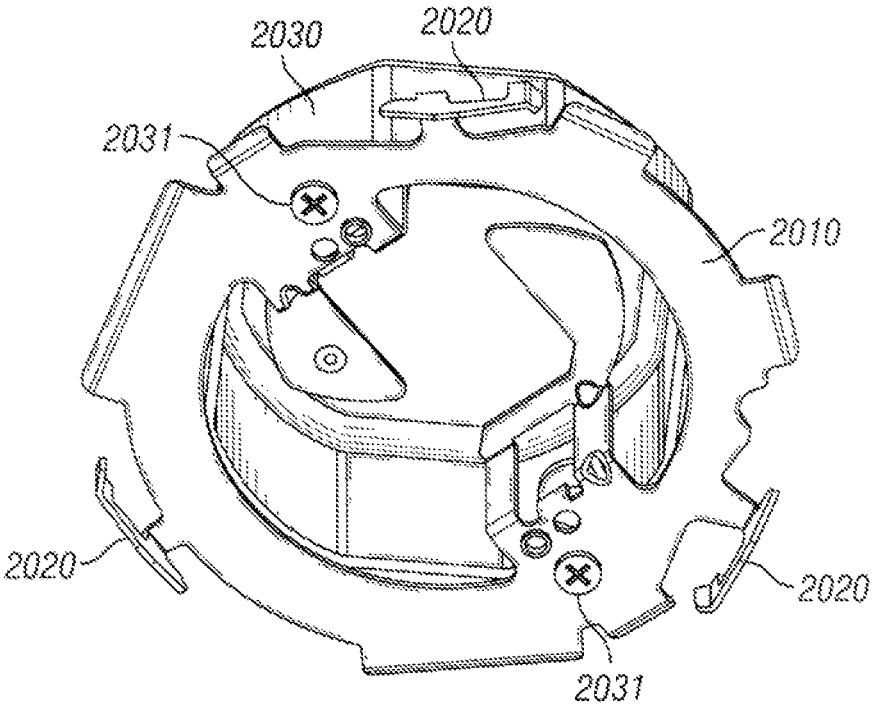
FIG. 24 illustrates a perspective view of a three-tab mounting bracket attached to a metal junction box in accordance with an example embodiment of the disclosure.

FIG. 24 illustrates a perspective view of the three-tab mounting bracket 2010 attached to a metal junction box 2030 in accordance with an example embodiment of the disclosure. Example fasteners 2031, in this case screws, attach the mounting bracket 2010 to the junction box 2030.

Figure 25:
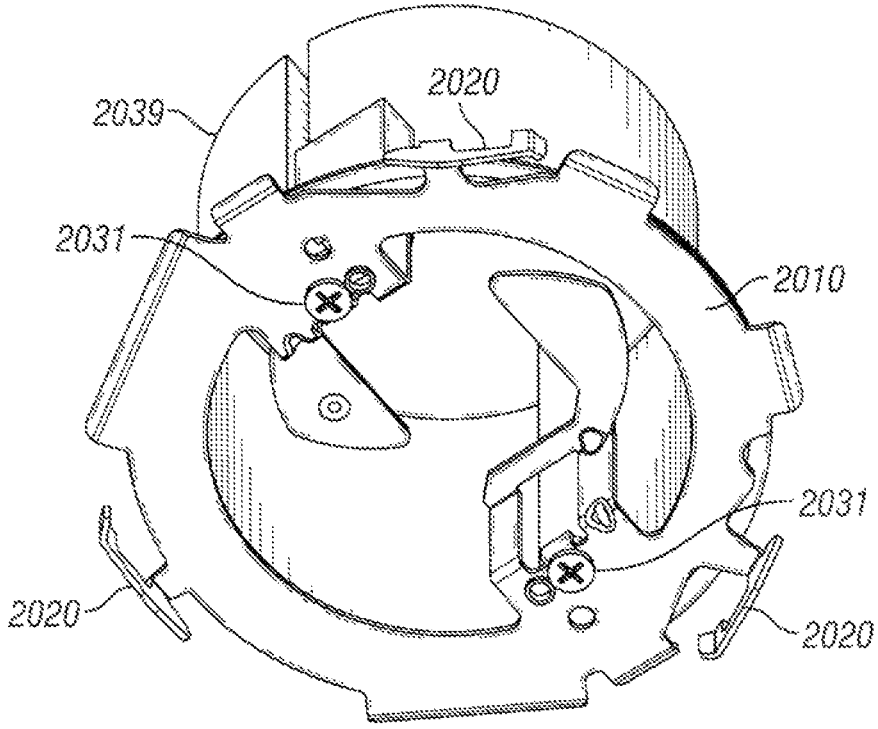
FIG. 25 illustrates a perspective view of a three-tab mounting bracket attached to a plastic junction box as may be used for recessed lighting in accordance with an example embodiment of the disclosure.

FIG. 25 illustrates a perspective view of the three-tab mounting bracket 2010 attached to a plastic junction box 2039 as may be used for recessed lighting applications (among other applications) in accordance with an example embodiment of the disclosure. Fasteners 2031, in this example screws, attach the mounting bracket 2010 to the junction box 2039.

Figure 26:
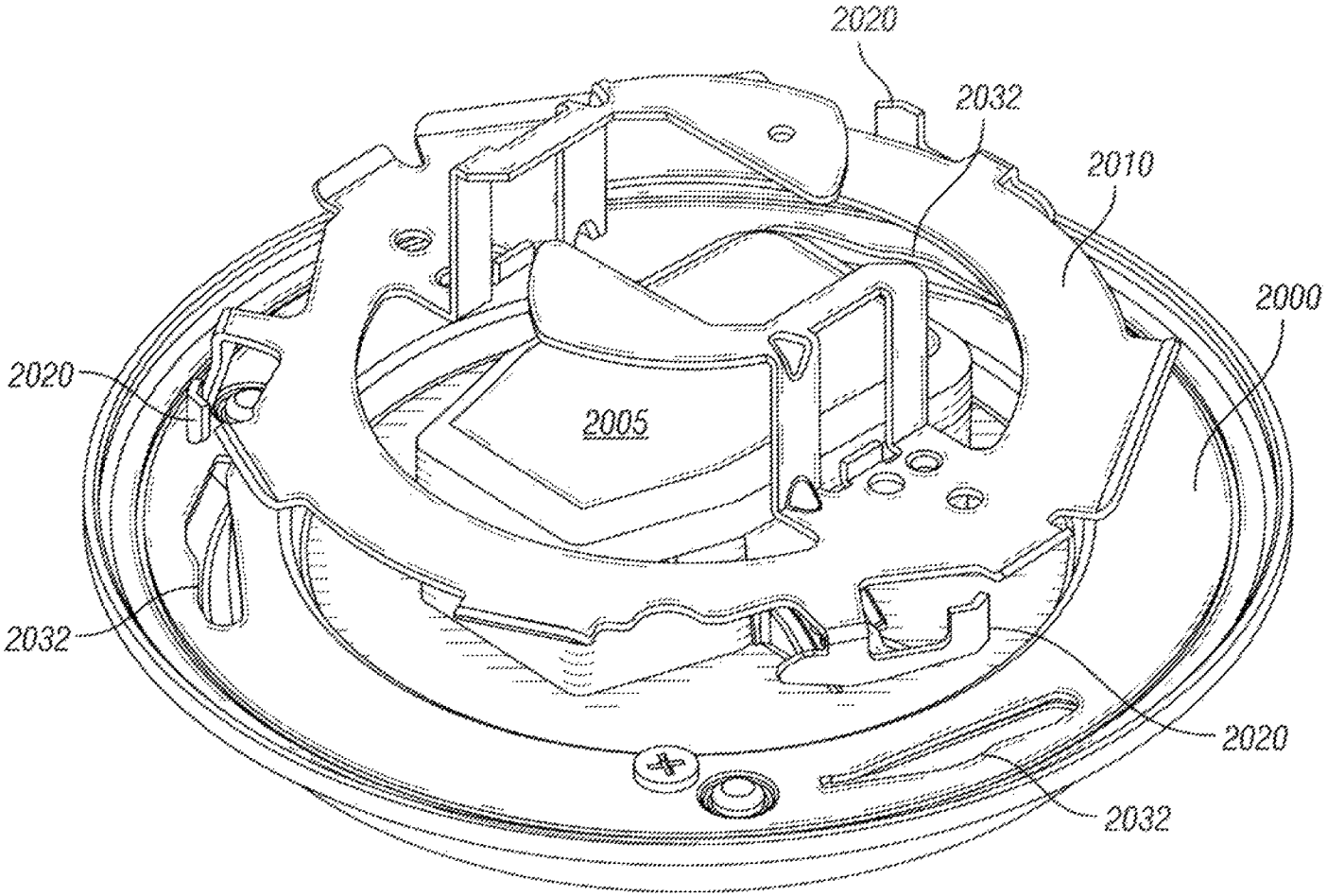
FIG. 26 illustrates a perspective view of a three-tab mounting bracket aligned for fastening to a luminaire in accordance with an example embodiment of the disclosure.

FIG. 26 illustrates a perspective view of the three-tab mounting bracket 2010 aligned for fastening to the luminaire 2000 in accordance with an example embodiment of the disclosure. In a typical installation, the mounting bracket 2010 would be attached to a junction box (or other structure) as illustrated in FIGS. 24 and 25, prior to fastening the luminaire 2000 to the mounting bracket. To improve reader visibility, such a junction box is not depicted in FIG. 26.

In the illustrated configuration of FIG. 26, the bracket 2010 is centered over the power system 2005 of the luminaire 2000, and the mounting tabs 2020, are radially disposed and are aligned with slots 2032 in the luminaire 2000 that will receive and fasten to the mounting tabs 2032 when the luminaire 2000 is raised and rotated.

Figure 27:
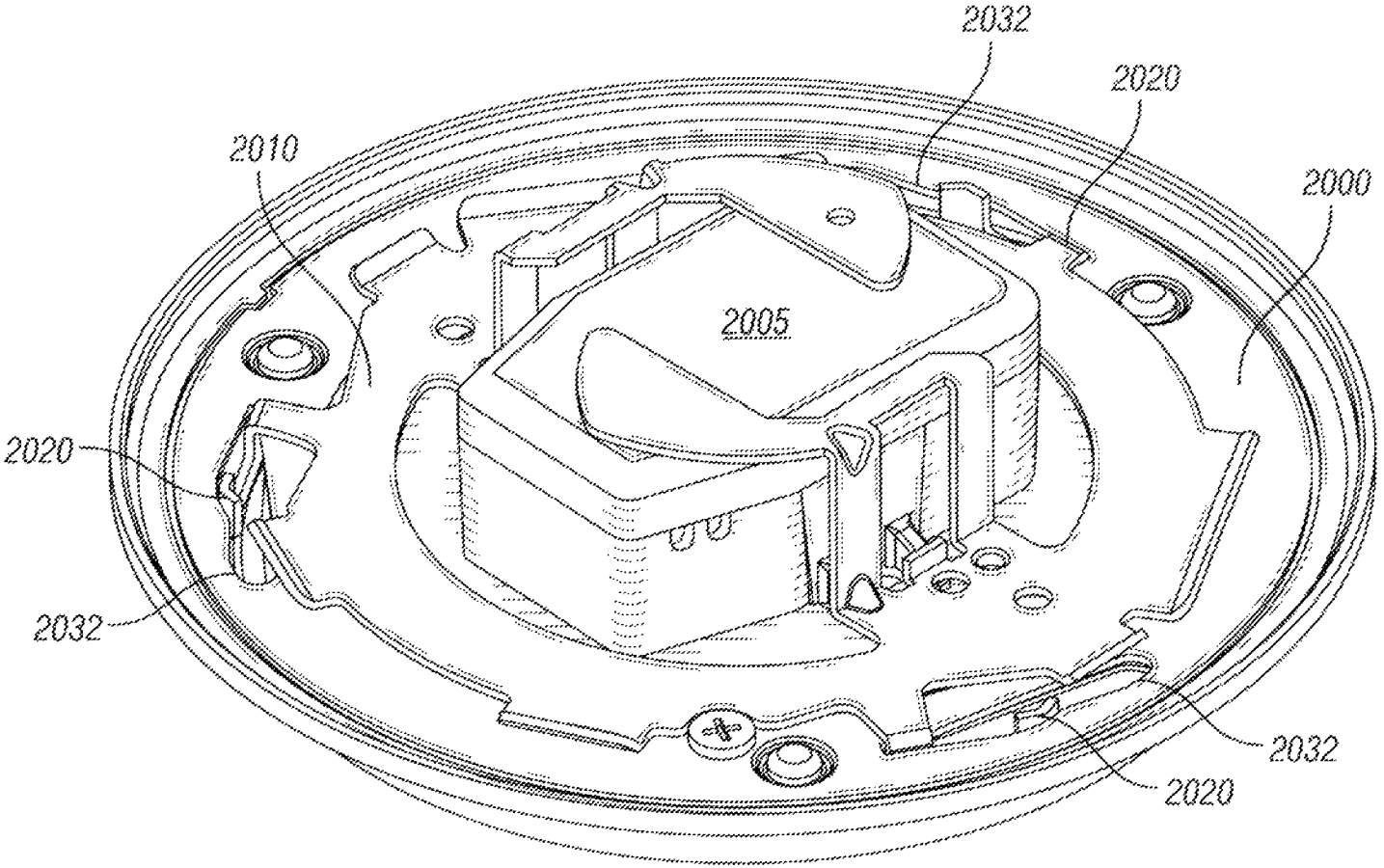
FIG. 27 illustrates a perspective view of a three-tab mounting bracket fastened to a luminaire in accordance with an example embodiment of the disclosure.

FIG. 27 illustrates a perspective view of the three-tab mounting bracket 2010 fastened to the luminaire 2000 in accordance with an example embodiment of the disclosure. In this view, the luminaire 2000 is raised and rotated into the locked position.

Figure 28:
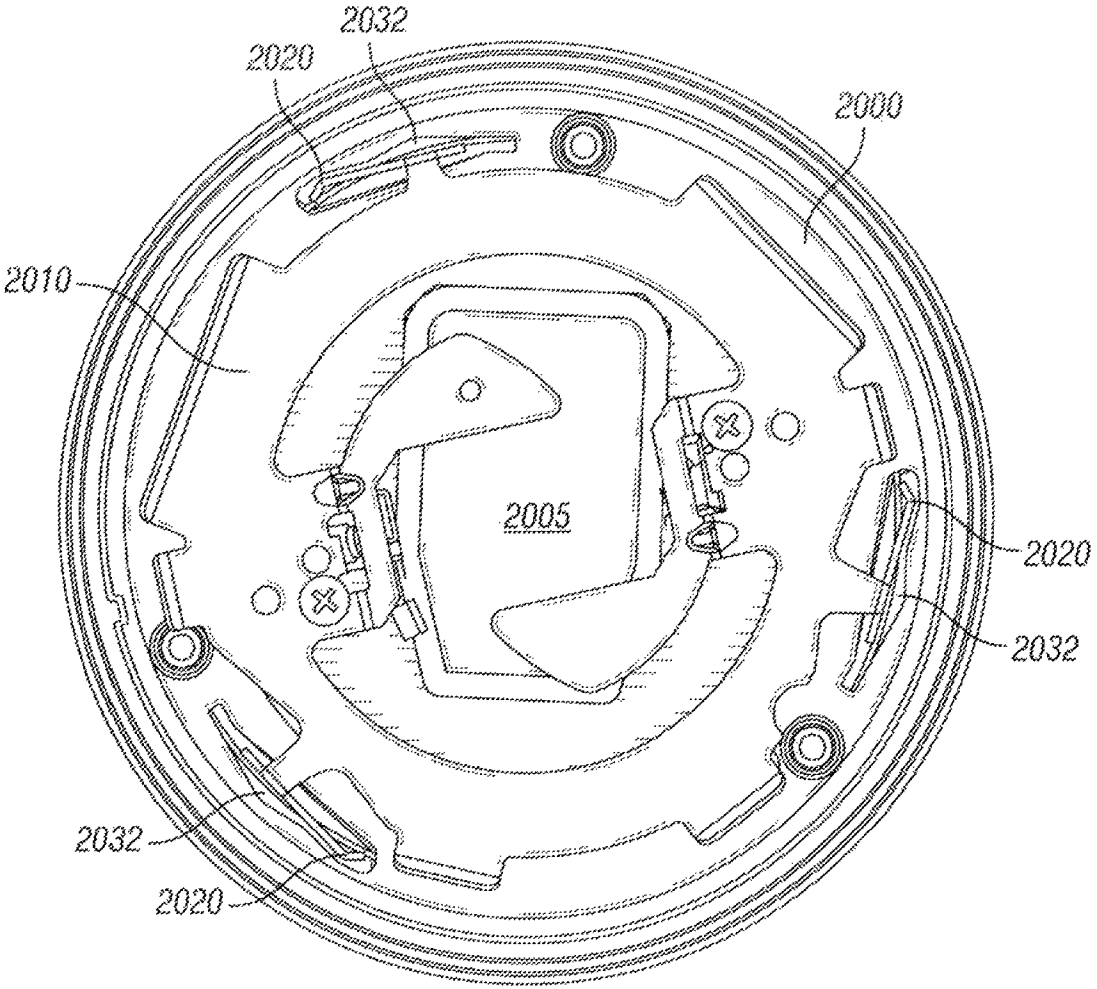
FIG. 28 illustrates an overhead view of a three-tab mounting bracket aligned for fastening to a luminaire in accordance with an example embodiment of the disclosure.

FIG. 28 illustrates an overhead view of the three-tab mounting bracket 2010 aligned for fastening to the luminaire 2000 in accordance with an example embodiment of the disclosure. Here, the luminaire 2000 is raised so that the mounting tabs 2020 are disposed in the slots 2032 in the unlocked position.

Figure 29:
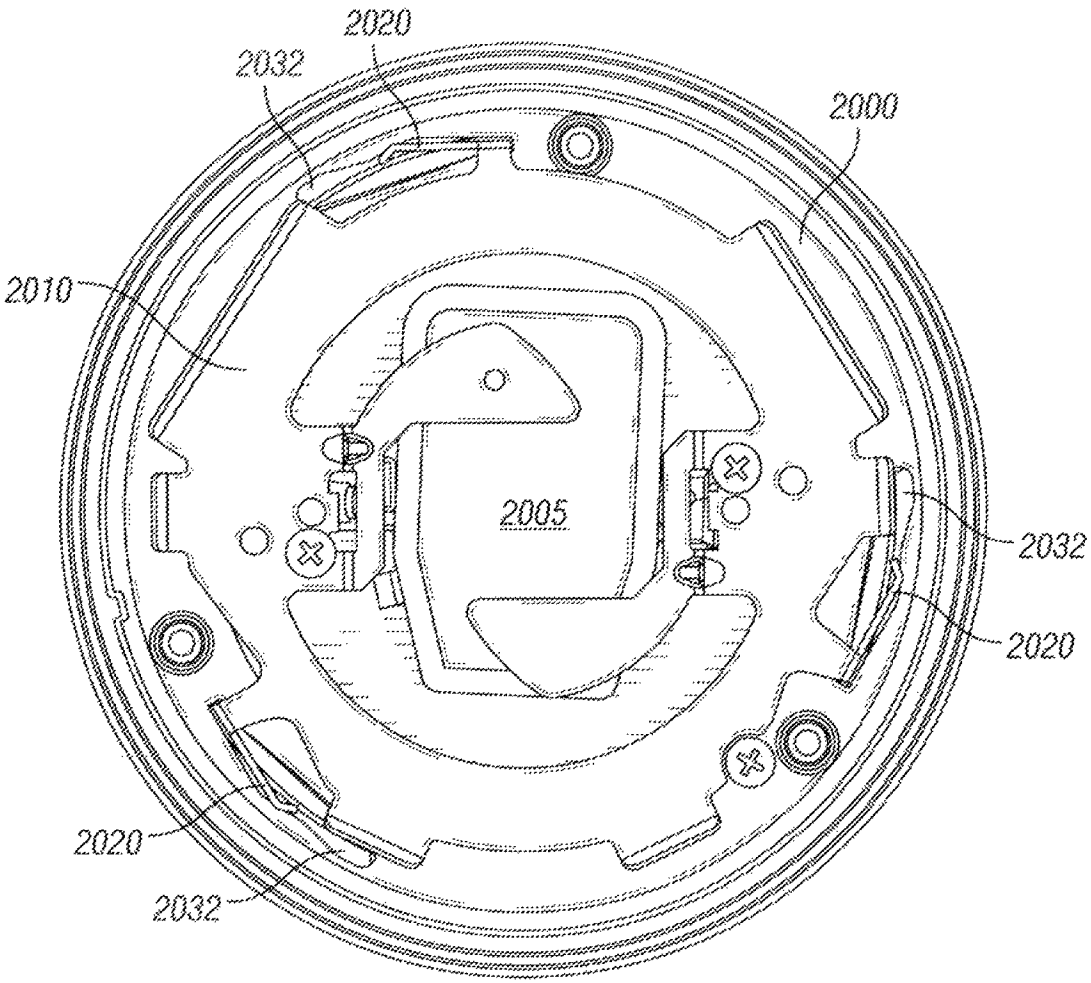
FIG. 29 illustrates an overhead view of a three-tab mounting bracket fastened to a luminaire in accordance with an example embodiment of the disclosure.

FIG. 29 illustrates an overhead view of the three-tab mounting bracket 2010 fastened to the luminaire 2000 in accordance with an example embodiment of the disclosure. Here, the mounting tabs 2020 are disposed in the slots 2032 in the locked position, which in the illustrated embodiment can be achieved by rotating the luminaire 2000 relative to the mounting bracket 2010.

Figure 30:
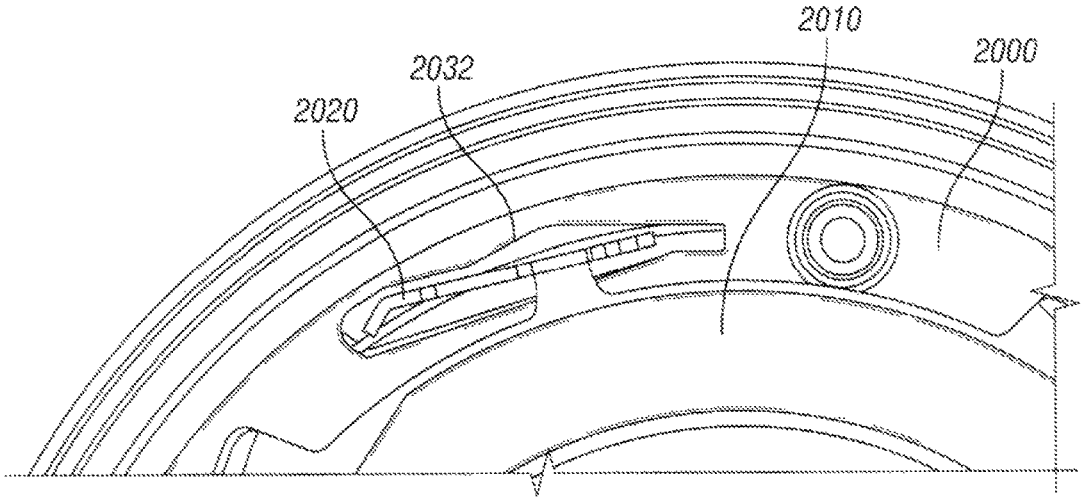
FIG. 30 illustrates a detail view of a three-tab mounting bracket aligned for fastening to a luminaire in accordance with an example embodiment of the disclosure.

FIG. 30 illustrates a detail view of the three-tab mounting bracket 2010 aligned for fastening to the luminaire 2000 in accordance with an example embodiment of the disclosure. Here, the mounting tabs 2020 are disposed in the slots 2032 in the unlocked position.

Figure 31:
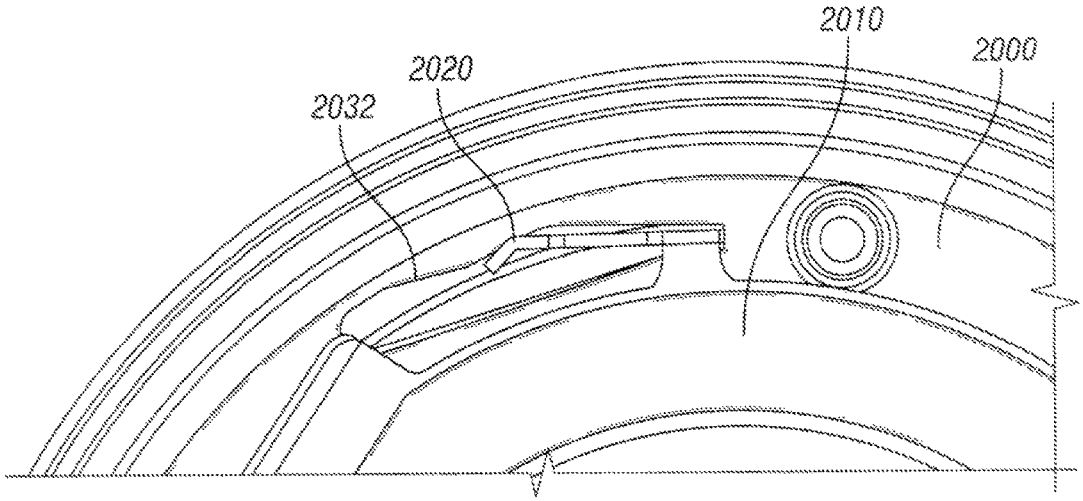
FIG. 31 illustrates a detail view of a three-tab mounting bracket fastened to a luminaire in accordance with an example embodiment of the disclosure.

FIG. 31 illustrates a detail view of the three-tab mounting bracket 2010 fastened to the luminaire 2000 in accordance with an example embodiment of the disclosure. Here, the mounting tabs 2020 are disposed in the slots 2032 in the locked position.

Figure 32:
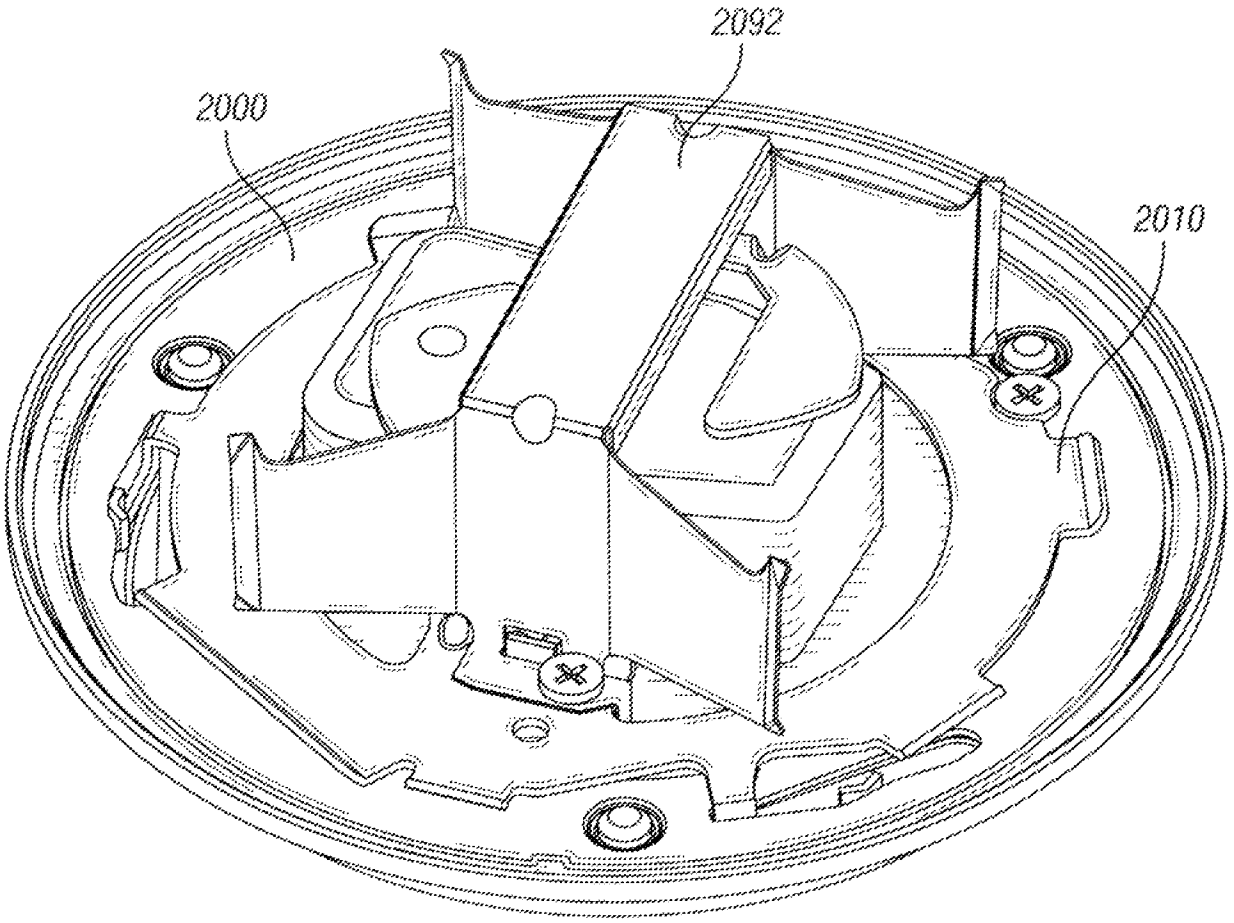
FIG. 32 illustrates a perspective view of a system in which a luminaire is attached to a three-tab mounting bracket, the mounting bracket is connected to a friction spring, and the friction spring is configured for attaching to a recessed housing above a ceiling in accordance with an example embodiment of the disclosure.

FIG. 32 illustrates a perspective view of a system in which the luminaire 2000 is attached to the three-tab mounting bracket 2010, the mounting bracket 2010 is connected to a friction spring 2092, and the friction spring 2092 is configured for attaching to a recessed housing or other structure above a ceiling in accordance with an example embodiment of the disclosure. In installation, the friction spring 2092 may be mounted via wedging, for example.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A system for mounting a luminaire, the system comprising:

a bracket configured for partial insertion in a first aperture of a ceiling and attachment to a junction box separately mounted above the ceiling, the bracket comprising:
- a center portion dimensioned for insertion in the separately mounted junction box via the first aperture;
- an outer portion dimensioned to obstruct insertion in the first aperture;
- one or more second apertures in the center portion arranged for fastening the bracket to the junction box when the center portion is inserted in the separately mounted junction box via the first aperture; and
- one or more first fasteners disposed on the outer portion of the bracket; and a luminaire comprising:
- a power system sized for insertion in the first aperture;
- a rim sized larger than the first aperture, the rim comprising a first side for facing the ceiling and a second side opposite the first side; and
- and one or more second fasteners disposed on the first side of the rim, wherein the one or more first fasteners and the one or more second fasteners fasten together to fasten the luminaire to the bracket.

2. The system of claim 1, wherein the center portion of the bracket comprises a receptacle for the power system of the luminaire, and wherein the power system comprises an LED driver.

3. The system of claim 2, wherein the receptacle is sized for insertion in the junction box.

4. The system of claim 1, wherein the one or more first fasteners and the one or more second fasteners fasten together in a slot-and-tab connection.

5. The system of claim 1, wherein the one or more first fasteners and the one or more second fasteners fasten together by rotation of the luminaire relative to the bracket.

6. The system of claim 1, wherein the one or more first fasteners and the one or more second fasteners are hidden from view when the one or more first fasteners and the one or more second fasteners are fastened together.

7. The system of claim 1, wherein the outer portion comprises two bracket arms that are separated from one another by the center portion, wherein the one or more first fasteners comprise two tabs disposed at respective ends of the two bracket arms, wherein each of the two tabs comprises a first portion and a second portion, wherein the one or more second fasteners comprise two slots, each sized to receive one of the two tabs, wherein each slot has a perimeter that comprises a notch and a protrusion, and wherein when the two slots receive the two tabs, the notch receives the first portion and the protrusion engages the second portion.

8. The system of claim 1, wherein each of the one or more first fasteners comprises a slot and each of the one or more second fasteners comprises a tab.

9. The system of claim 1, wherein each of the one or more second fasteners comprises a slot and each of the one or more first fasteners comprises a tab.

10. The system of claim 1, wherein the outer portion of the bracket comprises a disk.

11. A system comprising:

a mounting bracket comprising a center portion and at least two tabs, each disposed radially with respect to the center portion and separated by a distance; and at least two slots that are disposed on a back side of a luminaire and separated by the distance, each slot comprising a perimeter that comprises a notch and a protrusion, wherein the center portion is sized for insertion in a junction box mounted above an aperture in a ceiling, wherein the mounting bracket comprises two arms, each arm comprising a member extending between the center portion and a respective one of the at least two tabs, and wherein the mounting bracket is configured so that when the center portion is disposed in the junction box mounted above the aperture in the ceiling, each arm is disposed below the ceiling and extends along and substantially parallel to a lower surface of the ceiling.

12. The system of claim 11, wherein the at least two slots are oriented to engage the at least two tabs using the notch and the protrusion when the luminaire is rotated relative to the mounting bracket.

13. The system of claim 11, wherein each tab comprises a first portion and a second portion, and wherein each protrusion engages the first portion and each notch engages the second portion when the tabs are inserted in the slots and the luminaire is rotated relative to the mounting bracket.

14. The system of claim 11, wherein each tab is oriented perpendicular to the member.

15. The system of claim 11, wherein the mounting bracket further comprises a plurality of apertures that are arranged for attaching the mounting bracket to the junction box using a plurality of fasteners.

16. A system comprising:

a mounting bracket comprising a center portion and at least two slots, each slot disposed radially with respect to the center portion and separated by a distance, each slot comprising a perimeter that comprises a notch and a protrusion; and at least two tabs that are disposed on a back side of a luminaire and separated by the distance, wherein the center portion is sized for insertion in a junction box mounted above an aperture in a ceiling, wherein the mounting bracket comprises two arms, each arm comprising a flat member extending between the center portion and a respective one of the at least two slots, and wherein the mounting bracket is configured so that when the center portion is disposed in the junction box mounted above the aperture in the ceiling, each arm is disposed below the ceiling and extends along and substantially parallel to a lower surface of the ceiling.

17. The system of claim 16, wherein the at least two slots are oriented to engage the at least two tabs using the notch and the protrusion when the luminaire is rotated relative to the mounting bracket.

18. The system of claim 16, wherein each tab comprises a first portion and a second portion, and wherein each protrusion engages the first portion and each notch engages the second portion when the tabs are inserted in the slots and the luminaire is rotated relative to the mounting bracket.

19. The system of claim 16, wherein the mounting bracket further comprises a plurality of apertures that are arranged for attaching the mounting bracket to the junction box using a plurality of fasteners.

* * * * *